US011112719B2

(12) United States Patent
Makisumi et al.

(10) Patent No.: US 11,112,719 B2
(45) Date of Patent: Sep. 7, 2021

(54) PROCESS CARTRIDGE AND ELECTROPHOTOGRAPHIC APPARATUS CAPABLE OF SUPPRESSING LATERAL RUNNING WHILE MAINTAINING SATISFACTORY POTENTIAL FUNCTION

(71) Applicant: CANON KABUSHIKI KAISHA, Tokyo (JP)

(72) Inventors: Kohei Makisumi, Shizuoka (JP); Kaname Watariguchi, Kanagawa (JP); Fumiyuki Hiyama, Shizuoka (JP); Kazuhiro Yamauchi, Shizuoka (JP); Yuichi Kikuchi, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/065,258

(22) Filed: Oct. 7, 2020

(65) Prior Publication Data

US 2021/0116854 A1 Apr. 22, 2021

(30) Foreign Application Priority Data

Oct. 18, 2019 (JP) ..... JP2019-191570
Sep. 16, 2020 (JP) ..... JP2020-155391

(51) Int. Cl.
*G03G 15/02* (2006.01)

(52) U.S. Cl.
CPC ..... *G03G 15/0233* (2013.01); *G03G 2215/02* (2013.01)

(58) Field of Classification Search
CPC ..... G03G 15/0233; G03G 2215/02; G03G 2215/021
(Continued)

(56) References Cited

U.S. PATENT DOCUMENTS 5,783,344 A 7/1998 Kobayashi et al.
6,697,587 B2 2/2004 Harada
(Continued)

FOREIGN PATENT DOCUMENTS

JP 10268541 A 10/1998
JP 2002003651 A 1/2002
(Continued)

OTHER PUBLICATIONS

U.S. Appl. No. 17/069,919, filed Oct. 14, 2020, Tsutomu Nishida.
(Continued)

*Primary Examiner* — William J Royer
(74) *Attorney, Agent, or Firm* — Venable LLP

(57) ABSTRACT

Provided is a process cartridge in which lateral running is suppressed while satisfactory potential fluctuation is maintained. The process cartridge includes: an electrophotographic photosensitive member including a support, a lowermost layer, and a photosensitive layer; and a charging member including a support and a conductive layer. In a case where a maximum frequency at which a phase of an impedance reaches 45°, when the impedance is measured by applying an AC voltage to the lowermost layer while changing the AC voltage, is represented by $f_{OPC}$ (Hz), and in a case where a maximum frequency at which a phase of an impedance reaches 45°, when the impedance is measured by applying an AC voltage to the charging member while changing the AC voltage, is represented by $f_C$ (Hz), the $f_{OPC}$ and the $f_C$ each have a value within a certain range.

10 Claims, 7 Drawing Sheets

(58) Field of Classification Search
USPC ..... 399/176
See application file for complete search history.

(56) References Cited

U.S. PATENT DOCUMENTS

| | | | |
|---|---|---|---|
| 7,896,791 | B2 | 3/2011 | Yamazaki et al. |
| 8,298,670 | B2 | 10/2012 | Muranaka et al. |
| 8,449,975 | B2 | 5/2013 | Hirakoso et al. |
| 8,628,854 | B2 | 1/2014 | Yamauchi et al. |
| 8,668,987 | B2 | 3/2014 | Yamauchi et al. |
| 8,715,830 | B2 | 5/2014 | Yamada et al. |
| 8,771,818 | B2 | 7/2014 | Nishioka et al. |
| 8,841,052 | B2 | 9/2014 | Watariguchi et al. |
| 8,852,743 | B2 | 10/2014 | Kikuchi et al. |
| 8,974,991 | B2 | 3/2015 | Kawahara et al. |
| 9,023,465 | B2 | 5/2015 | Yamada et al. |
| 9,068,083 | B2 | 6/2015 | Tanaka et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 6/2016 | Masu et al. |
| 9,436,106 | B2 | 9/2016 | Kuno et al. |
| 9,442,408 | B2 | 9/2016 | Yamauchi et al. |
| 9,442,451 | B2 | 9/2016 | Yamauchi et al. |
| 9,459,542 | B2 | 10/2016 | Tanaka et al. |
| 9,500,966 | B2 | 11/2016 | Watariguchi et al. |
| 9,535,347 | B2 | 1/2017 | Watariguchi et al. |
| 9,541,854 | B2 | 1/2017 | Kikuchi et al. |
| 9,547,250 | B2 | 1/2017 | Kikuchi et al. |
| 9,551,949 | B2 | 1/2017 | Yamauchi et al. |
| 9,563,139 | B2 | 2/2017 | Kawahara et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,645,515 | B2 | 5/2017 | Kuno et al. |
| 9,645,516 | B2 | 5/2017 | Kawahara et al. |
| 9,651,880 | B2 | 5/2017 | Miyamoto |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,869,032 | B2 | 1/2018 | Kawahara et al. |
| 9,897,931 | B2 | 2/2018 | Nishioka et al. |
| 9,958,802 | B2 | 5/2018 | Kikuchi et al. |
| 9,964,914 | B2 | 5/2018 | Arimura et al. |
| 9,977,353 | B2 | 5/2018 | Nishioka et al. |
| 10,012,924 | B2 | 7/2018 | Yoshidome et al. |
| 10,018,927 | B2 | 7/2018 | Yamada et al. |
| 10,018,934 | B2 | 7/2018 | Yamada et al. |
| 10,108,129 | B2 | 10/2018 | Yamaguchi et al. |
| 10,280,148 | B2 | 5/2019 | Nishioka et al. |
| 10,416,588 | B2 | 9/2019 | Masu et al. |
| 10,558,136 | B2 * | 2/2020 | Furukawa et al. ..... G03G 15/0233 |
| 10,649,350 | B2 | 5/2020 | Yamaguchi et al. |
| 10,678,154 | B2 | 6/2020 | Takashima et al. |
| 10,678,158 | B2 | 6/2020 | Kikuchi et al. |
| 11,003,106 | B2 * | 5/2021 | Agata et al. ..... G03G 15/0233 |
| 2012/0308261 | A1 | 12/2012 | Tsuru et al. |
| 2013/0281276 | A1 | 10/2013 | Watanabe et al. |
| 2014/0141362 | A1 | 5/2014 | Watariguchi et al. |
| 2015/0093693 | A1 | 4/2015 | Watariguchi et al. |
| 2015/0331346 | A1 | 11/2015 | Yamauchi et al. |
| 2015/0346617 | A1 | 12/2015 | Kawahara et al. |
| 2015/0362847 | A1 | 12/2015 | Tanaka et al. |
| 2020/0159137 | A1 | 5/2020 | Ito et al. |
| 2020/0174385 | A1 | 6/2020 | Sakakibara et al. |
| 2020/0310264 | A1 | 10/2020 | Kurachi et al. |
| 2020/0310265 | A1 | 10/2020 | Nishioka et al. |
| 2020/0310266 | A1 | 10/2020 | Kikuchi et al. |
| 2020/0393771 | A1 | 12/2020 | Iwasaki et al. |
| 2020/0409278 | A1 | 12/2020 | Makisumi et al. |
| 2020/0409279 | A1 | 12/2020 | Sekiya et al. |
| 2020/0409280 | A1 | 12/2020 | Ishida et al. |
| 2020/0409281 | A1 | 12/2020 | Watariguchi et al. |
| 2021/0026295 | A1 | 1/2021 | Yamada et al. |
| 2021/0033996 | A1 | 2/2021 | Kikuchi et al. |
| 2021/0041796 | A1 | 2/2021 | Nishioka et al. |

FOREIGN PATENT DOCUMENTS

| | | | |
|---|---|---|---|
| JP | 2008293046 | A | 12/2008 |
| JP | 2012063447 | A | 3/2012 |
| JP | 2016139052 | A | 8/2016 |
| JP | 2017072833 | A | 4/2017 |

OTHER PUBLICATIONS

U.S. Appl. No. 17/070,054, filed Oct. 14, 2020, Yuka Ishiduka.
U.S. Appl. No. 17/070,085, filed Oct. 14, 2020, Fumiyuki Hiyama.
U.S. Appl. No. 17/070,179, filed Oct. 14, 2020, Kaname Watariguchi.
U.S. Appl. No. 17/071,103, filed Oct. 15, 2020, Noriyoshi Umeda.
U.S. Appl. No. 17/071,109, filed Oct. 15, 2020, Shohei Kototani.
U.S. Appl. No. 17/071,227, filed Oct. 15, 2020, Kosuke Fukudome.
U.S. Appl. No. 17/071,246, filed Oct. 15, 2020, Tomohiro Unno.
U.S. Appl. No. 17/071,283, filed Oct. 15, 2020, Yoshitaka Suzumura.
U.S. Appl. No. 17/071,535, filed Oct. 15, 2020, Hiroyuki Tomono.
U.S. Appl. No. 17/071,540, filed Oct. 15, 2020, Tsuneyoshi Tominaga.

* cited by examiner

PROCESS CARTRIDGE AND ELECTROPHOTOGRAPHIC APPARATUS CAPABLE OF SUPPRESSING LATERAL RUNNING WHILE MAINTAINING SATISFACTORY POTENTIAL FUNCTION

BACKGROUND OF THE INVENTION

Field of the Invention

The present disclosure relates to a process cartridge and an electrophotographic apparatus, which include an electrophotographic photosensitive member and a charging member.

Description of the Related Art

An electrophotographic process related to an electrophotographic photosensitive member (hereinafter sometimes simply referred to as "photosensitive member") includes mainly four processes of charging, exposure, development, and transfer, and as required, includes processes such as cleaning and pre-exposure. Of those, the charging process and the exposure process are processes vital for forming an electrostatic latent image, which involve controlling a charge distribution of the photosensitive member to set the surface of the photosensitive member to a desired potential distribution. The charging process involves generating discharge from a charging member (charging unit) to the electrophotographic photosensitive member, to thereby charge the surface of the photosensitive member. In this case, when electrical characteristics of the photosensitive member and the charging member, and frequency dependence of the electrical characteristics are not appropriately designed, there occur a phenomenon in which the discharge becomes excessive to cause dielectric breakdown of the photosensitive member (hereinafter sometimes referred to as "leakage"), and a charging defect phenomenon caused by destabilization of the discharge, to thereby cause problems. Therefore, a layer having a resistance controlled (hereinafter referred to as "lowermost layer") is formed immediately on a support of the photosensitive member separately from a photosensitive layer to electrically shield irregularities caused by burrs and the like on the surface of the support, to thereby suppress the leakage and the charging defect.

When the photosensitive member characteristics are considered from the viewpoint of an electric resistance, it is desired that the electric resistance be high from the viewpoints of suppressing the leakage and suppressing the charging defect by improvement of charging ability. However, when the electric resistance is excessively increased, optical sensitivity is deteriorated in the exposure process. In particular, when image printing is repeatedly performed through use of the photosensitive member having a high electric resistance, electric charge removal is unsatisfactory, and hence electric charge is accumulated in the photosensitive member through long-term use. Therefore, a light potential is gradually increased (hereinafter sometimes referred to as "potential fluctuation"), and contrast with a dark potential is decreased. Thus, when the exposure process is considered, it is preferred that the photosensitive member have a low electric resistance.

The electrical characteristics have hitherto been optimized in consideration of the frequency dependence by designing the electrical characteristics of the lowermost layer and the photosensitive member based on an impedance. With this, with respect to a characteristic time scale that varies depending on the electrophotographic process, such as the charging process or the exposure process, the electrical characteristics in a frequency band corresponding to each time constant have been optimized in accordance with the process, to thereby solve the above-mentioned problem.

Meanwhile, as the charging member configured to apply electric charge to the photosensitive member in the charging process, a corona-type charging member, a roller-type charging member, and the like have mainly hitherto been used. Of those, the corona-type charging member requires an application voltage higher than that of the roller-type charging member, and hence the size and cost of a required power source cause problems. In contrast, the roller-type charging member requires a low application voltage, and hence the size and cost of a power source can be suppressed to be low. However, the roller-type charging member has a problem in that uniformity and stability of charging are inferior to those of the corona-type charging member.

In addition, in the roller-type charging member (hereinafter sometimes referred to as "charging roller"), the charging roller and the photosensitive member are brought into direct contact with each other. Therefore, due to foreign matter contamination to the photosensitive layer and dent caused by shock thereto, the photosensitive member is locally damaged up to the surface of the lowermost layer, or a hole is formed therein, with the result that a voltage applied to the photosensitive member in the local region is greatly divided to the lowermost layer. In such a case, a large electric current flows from a surface layer side to a support side of the photosensitive member through the region. Then, the supply of electric charge to the charging roller becomes insufficient, and discharge to the surface of the photosensitive member is not sufficiently performed, with the result that a linear charging defect occurs in a longitudinal direction of the charging roller. When an image is printed in this state, an image having a black line drawn thereon in a longitudinal direction of the photosensitive member (hereinafter referred to as "lateral running image") is output. This phenomenon (hereinafter referred to as "lateral running") has been a problem because the occurrence of foreign matter contamination and dent caused by shock cannot be completely controlled.

In Japanese Patent Application Laid-Open No. H10-268541, there is described a photosensitive member including a photosensitive layer containing a photoconductive material on an aluminum base having an aluminum oxide film on a surface. Through control of the impedance of the aluminum oxide film, fogging caused by a local charging defect is suppressed.

In Japanese Patent Application Laid-Open No. 2016-139052, there is described a photosensitive member including an undercoat layer in which the angular frequency $\omega_{max}$ (rad) at which a complex impedance component becomes maximum satisfies $2 \leq \omega_{max} \leq 10$. When the impedance of the undercoat layer is controlled within the above-mentioned range, the occurrence of abnormal discharge caused by excessive movement of electric charge in the undercoat layer in a charging process is suppressed, and a streak-like image defect in an image having low image density is suppressed.

In Japanese Patent Application Laid-Open No. 2002-3651, there are described a rubber composition having a sea-island structure including a polymer continuous phase made of an ion conductive rubber material containing, as a main component, a raw material rubber A having a specific volume resistivity of $1 \times 10^{12}$ Ω·cm or less and a polymer particle phase made of an electron conductive rubber material obtained by blending conductive particles with a raw material rubber B, to thereby make the raw material rubber B conductive, and a charging member including an elastic layer formed of the rubber composition. When the ion conductive rubber material and the electron conductive rubber material form a sea-island structure, the resistance stability of the charging member is excellent.

According to the investigations made by the inventors, in the electrophotographic photosensitive member and the charging member described in Japanese Patent Application Laid-Open No. H10-268541, Japanese Patent Application Laid-Open No. 2016-139052, and Japanese Patent Application Laid-Open No. 2002-3651, it is difficult to suppress lateral running while maintaining satisfactory potential fluctuation.

SUMMARY OF THE INVENTION

One aspect of the present disclosure is directed to provision of a process cartridge capable of suppressing lateral running while maintaining satisfactory potential fluctuation. In addition, another aspect of the present disclosure is directed to provision of an electrophotographic apparatus capable of forming a high-quality electrophotographic image.

According to one aspect of the present disclosure, there is provided a process cartridge including: an electrophotographic photosensitive member; and a charging member, the process cartridge being removably mounted onto a main body of an electrophotographic apparatus, wherein the electrophotographic photosensitive member includes a first support having a cylindrical shape, a lowermost layer formed immediately on the first support, and a photosensitive layer formed on the lowermost layer, wherein the charging member is an electrophotographic charging member including a second support having a columnar shape and a second conductive layer formed on the second support, wherein the second conductive layer includes a matrix containing a first rubber and a plurality of domains dispersed in the matrix, wherein the plurality of domains each contain a second rubber and an electron conductive agent, wherein the matrix has a volume resistivity $\rho_M$ that is $1.0\times10^5$ times or more as large as a volume resistivity $\rho_D$ of each of the plurality of domains, and wherein, in a case where a maximum frequency at which a phase of an impedance reaches 45°, when the impedance is measured by applying an AC voltage to the lowermost layer while changing the AC voltage at a frequency within a range of from $1.0\times10^{-1}$ (Hz) to $1.0\times10^6$ (Hz), is represented by $f_{OPC}$ (Hz), and in a case where a maximum frequency at which a phase of an impedance reaches 45°, when the impedance is measured by applying an AC voltage to the charging member while changing the AC voltage at a frequency within a range of from $1.0\times10^{-2}$ (Hz) to $1.0\times10^6$ (Hz), is represented by $f_C$ (Hz), the $f_{OPC}$ and the $f_C$ satisfy a relationship of one of the following expression (D1) and the following expression (D2):

$$10 \leq f_{OPC}/f_C \leq 10{,}000 \quad \text{Expression (D1)}$$

$$0.0001 \leq f_{OPC}/f_C \leq 0.1 \quad \text{Expression (D2).}$$

According to another aspect of the present disclosure, there is provided an electrophotographic apparatus including: an electrophotographic photosensitive member; and a charging member, wherein the electrophotographic photosensitive member includes a first support having a cylindrical shape, a lowermost layer formed immediately on the first support, and a photosensitive layer formed on the lowermost layer, wherein the charging member is an electrophotographic charging member including a second support having a columnar shape and a second conductive layer formed on the second support, wherein the second conductive layer includes a matrix containing a first rubber and a plurality of domains dispersed in the matrix, wherein the plurality of domains each contain a second rubber and an electron conductive agent, wherein the matrix has a volume resistivity $\rho_M$ that is $1.0\times10^5$ times or more as large as a volume resistivity $\rho_D$ of each of the plurality of domains, and wherein, in a case where a maximum frequency at which a phase of an impedance reaches 45°, when the impedance is measured by applying an AC voltage to the lowermost layer while changing the AC voltage at a frequency within a range of from $1.0\times10^{-2}$ (Hz) to $1.0\times10^6$ (Hz), is represented by $f_{OPC}$ (Hz), and in a case where a maximum frequency at which a phase of an impedance reaches 45°, when the impedance is measured by applying an AC voltage to the charging member while changing the AC voltage at a frequency within a range of from $1.0\times10^{-2}$ (Hz) to $1.0\times10^6$ (Hz), is represented by $f_C$ (Hz), the $f_{OPC}$ and the $f_C$ satisfy a relationship of one of the following expression (D1) and the following expression (D2):

$$10 \leq f_{OPC}/f_C \leq 10{,}000 \quad \text{Expression (D1)}$$

$$0.0001 \leq f_{OPC}/f_C \leq 0.1 \quad \text{Expression (D2).}$$

Further features of the present disclosure will become apparent from the following description of exemplary aspects with reference to the attached drawings.

DESCRIPTION OF THE EMBODIMENTS

The present disclosure is described in detail below by way of exemplary aspects.

The inventors have made investigations, and as a result, have found that the effect of suppressing the above-mentioned lateral running caused by foreign matter contamination and dent while maintaining satisfactory potential fluctuation cannot be exhibited merely by optimizing each impedance of an aluminum oxide film and an undercoat layer in a related-art photosensitive member.

In view of the foregoing, the inventors have found that, in order to optimize a combination of a photosensitive member and a charging member to solve the above-mentioned problem, the photosensitive member and the charging member are each designed as described below, and further a combination thereof is optimized, thereby being capable of suppressing the lateral running while maintaining satisfactory potential fluctuation.

<Design of Photosensitive Member>

The inventors have found that it is required to form, in the photosensitive member, a lowermost layer on a cylindrical support (the support of the photosensitive member is hereinafter referred to as "first support"). The lowermost layer serves to prevent the first support from being completely exposed when foreign matter contamination and dent occur in the photosensitive member.

<Design of Charging Member>

In addition, the inventors have found that it is required that the charging member be a charging member including a conductive layer (the conductive layer of the charging member is hereinafter referred to as "second conductive layer") formed on a columnar support (the support of the charging member is hereinafter referred to as "second support"), the second conductive layer have a sea-island structure (see FIG. 2), and further a sea portion have a certain resistance or more as compared to that of an island portion.

Figure 2:
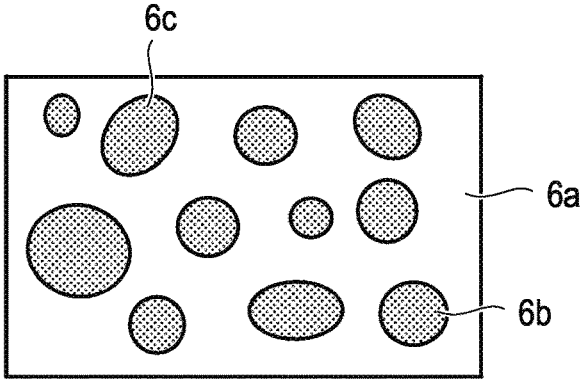
FIG. 2 is a schematic view of a sea-island structure of a charging member in the present disclosure.

Herein, as illustrated in FIG. 2, the "sea-island structure" of the second conductive layer refers to a structure which includes a matrix 6*a* corresponding to the sea portion containing a first rubber and a plurality of domains 6*b* corresponding to the island portions dispersed in the matrix 6*a*, and in which the domains 6*b* each contain a second rubber and an electron conductive agent 6*c*. In addition, the phrase "sea portion has a certain resistance or more as compared to that of an island portion" specifically means, for example, that a ratio $\rho_M/\rho_D$ between a volume resistivity $\rho_M$ (Ω·cm) of the matrix 6*a* and a volume resistivity $\rho_D$ (Ω·cm) of the domains 6*b* is $1.0\times10^5$ or more.

<Optimization of Combination of Photosensitive Member and Charging Member>

In the present disclosure, when the photosensitive member and the charging member are combined with each other, it is required that the reaction frequency of the photosensitive member and the reaction frequency of the charging member not be apart from each other by a threshold limit value or more while being apart from each other by a certain level or more.

The "reaction frequency" as used herein means a maximum frequency at which a phase of an impedance reaches 45° when the impedance is measured by applying an AC voltage to the photosensitive member or the charging member while changing the AC voltage at a frequency within a range of from $1.0\times10^{-2}$ (Hz) to $1.0\times10^6$ (Hz). The reaction frequency of the photosensitive member is represented by $f_{OPC}$ (Hz), and the reaction frequency of the charging member is represented by $f_C$ (Hz). In addition, the phrase "being apart from each other by a certain level or more" means that a ratio between the reaction frequency $f_{OPC}$ of the photosensitive member and the reaction frequency $f_C$ of the charging member is one or more digits, that is, the ratio $f_{OPC}/f_C$ is 10 or more or 0.1 or less. In addition, the phrase "not be apart from each other by a threshold limit value or more" as used herein means that the ratio between the reaction frequency $f_{OPC}$ of the photosensitive member and the reaction frequency $f_C$ of the charging member is four or less digits, that is, the ratio $f_{OPC}/f_C$ is 10,000 or less or 0.0001 or more. Specifically, the ratio $f_{OPC}/f_C$ satisfies a relationship of one of the following expression (D1) and the following expression (D2).

$$10 \le f_{OPC}/f_C \le 10{,}000 \quad \text{Expression (D1)}$$

$$0.0001 \le f_{OPC}/f_C \le 0.1 \quad \text{Expression (D2)}$$

Figure 4:
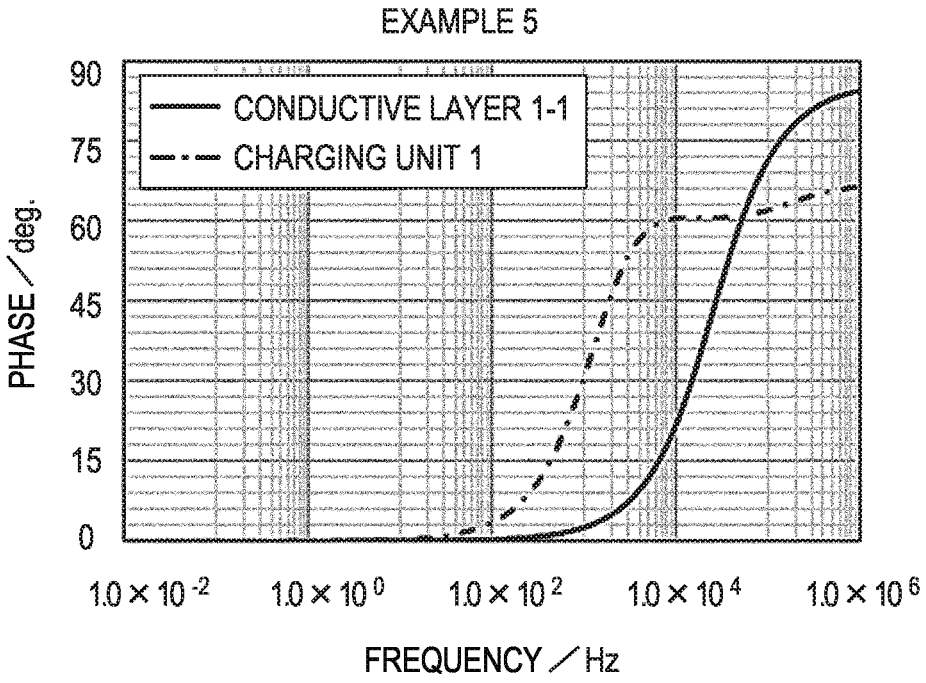
FIG. 4 is an explanatory graph showing impedance characteristics in Example 5 of the present disclosure.
Figure 5:
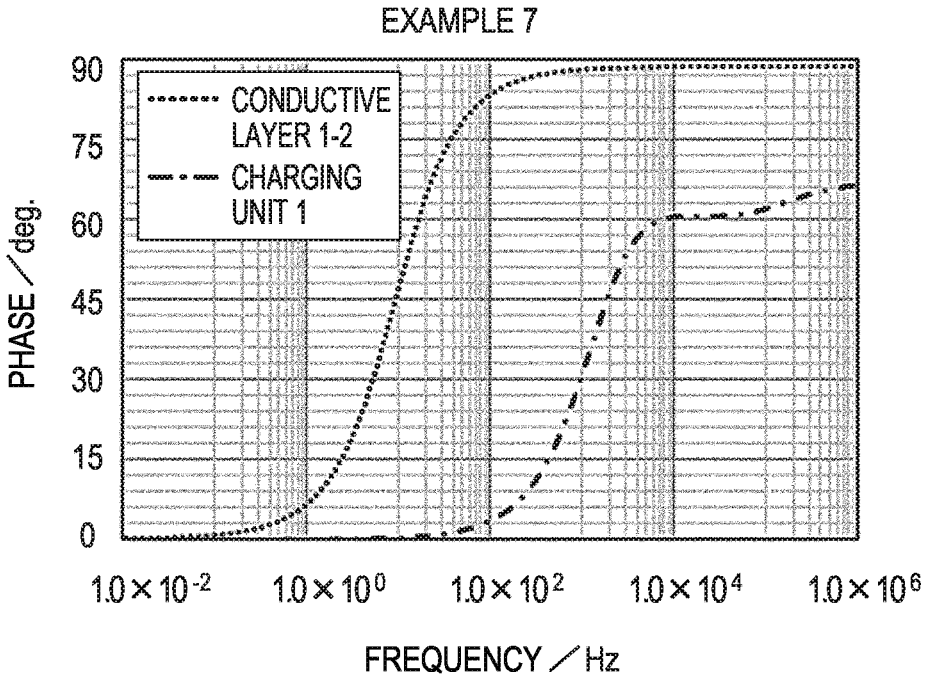
FIG. 5 is an explanatory graph showing impedance characteristics in Example 7 of the present disclosure.
Figure 6:
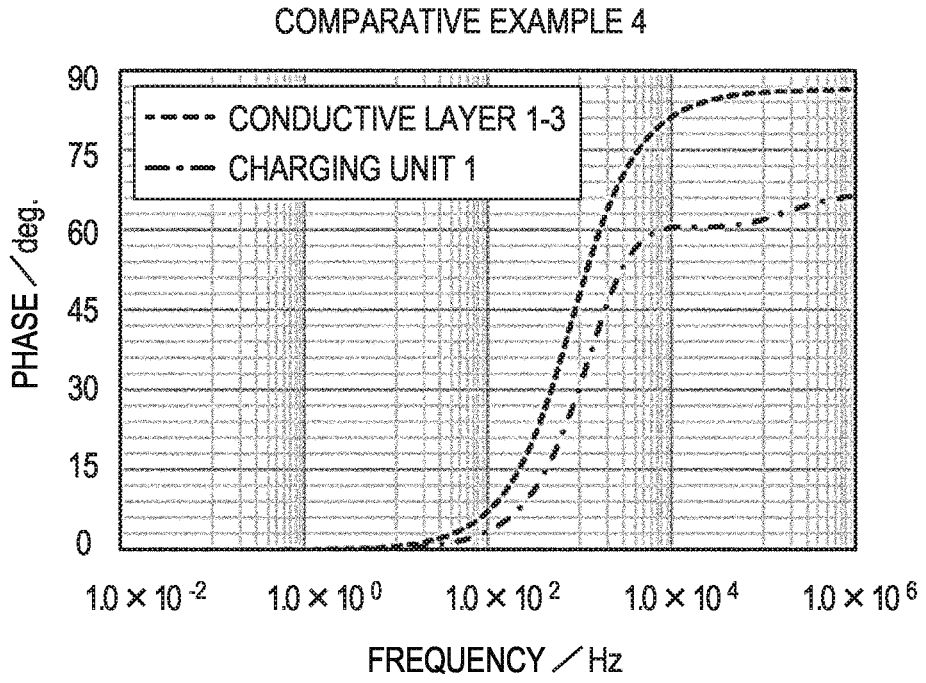
FIG. 6 is an explanatory graph showing impedance characteristics in Comparative Example 4 of the present disclosure.
Figure 7:
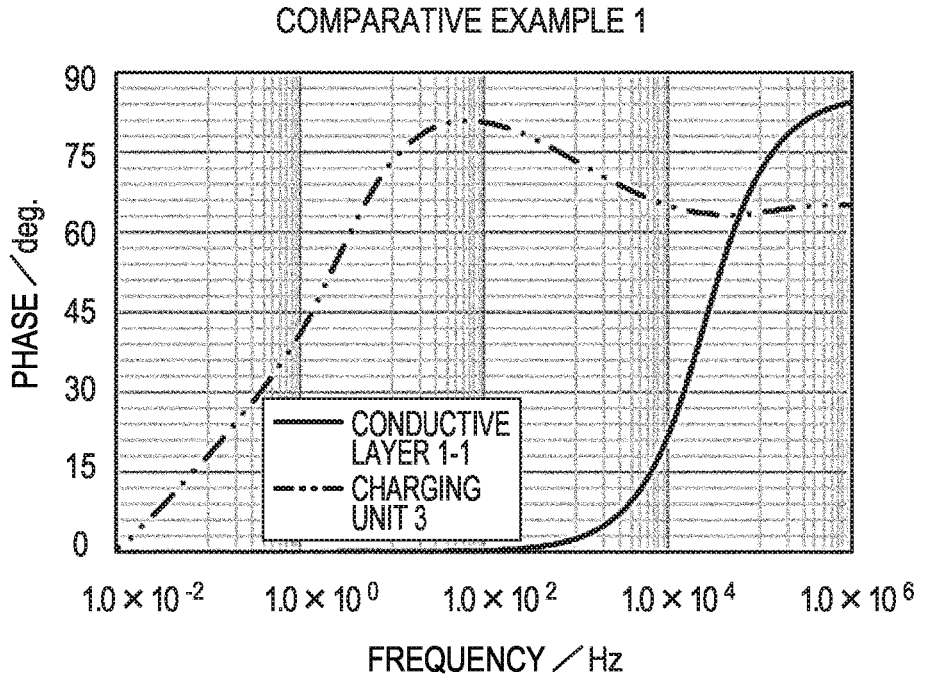
FIG. 7 is an explanatory graph showing impedance characteristics in Comparative Example 1 of the present disclosure.
Figure 8:
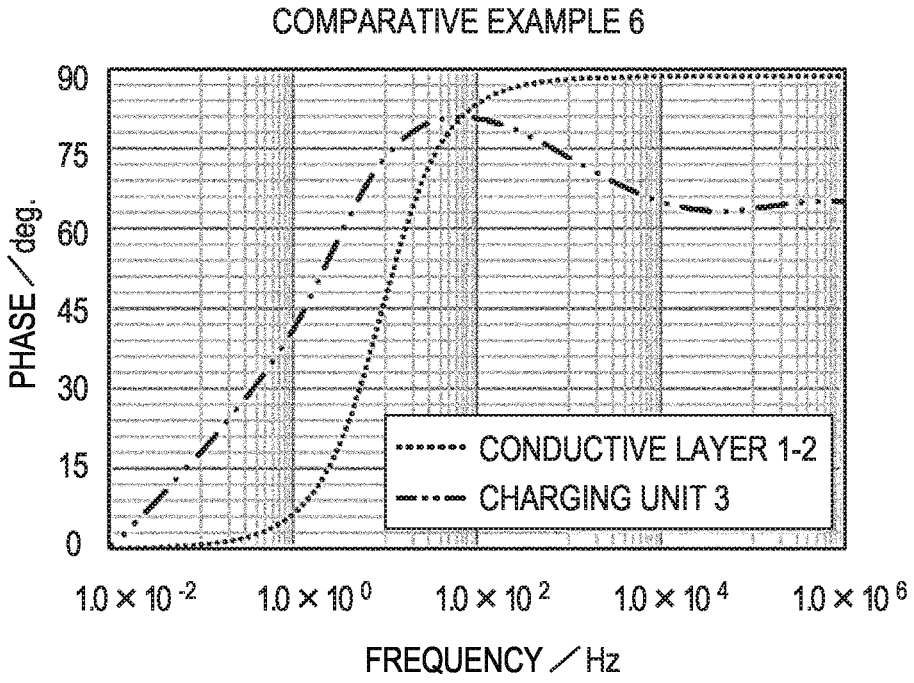
FIG. 8 is an explanatory graph showing impedance characteristics in Comparative Example 6 of the present disclosure.
Figure 9:
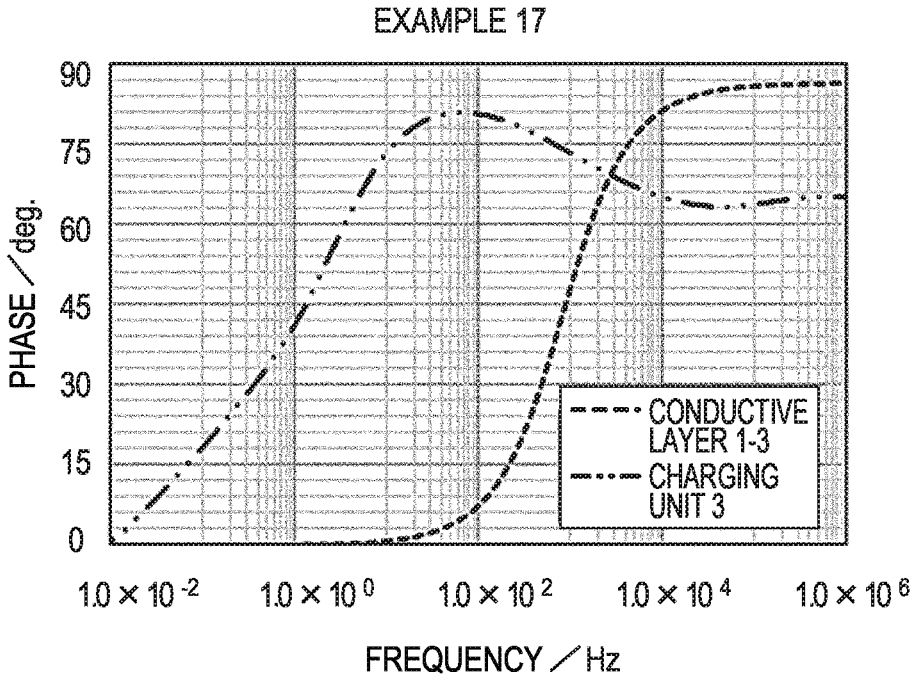
FIG. 9 is an explanatory graph showing impedance characteristics in Example 17 of the present disclosure.

In each of FIG. 4, FIG. 5, FIG. 6, FIG. 7, FIG. 8, and FIG. 9, there are shown measurement results of impedance of the lowermost layer of the photosensitive member and the charging member in a configuration of Example or Comparative Example of the present disclosure. In each of FIG. 4, FIG. 5, and FIG. 6, there are shown measurement results of impedance when the lowermost layer is changed with respect to the same charging member. In each of FIG. 4 and FIG. 5, the reaction frequency $f_{OPC}$ of the lowermost layer and the reaction frequency $f_C$ of the charging member are not apart from each other by a threshold limit value or more while being apart from each other by a certain level or more, and hence the effects of the present disclosure are exhibited. Meanwhile, in FIG. 6, the reaction frequency $f_{OPC}$ of the lowermost layer and the reaction frequency $f_C$ of the charging member are excessively close to each other, and hence the effects of the present disclosure are not exhibited. In FIG. 7, FIG. 8, and FIG. 9, there are shown measurement results of impedance when the charging members in FIG. 4, FIG. 5, and FIG. 6 are changed, respectively. In FIG. 7, the two reaction frequencies, that is, the reaction frequency $f_{OPC}$ of the lowermost layer and the reaction frequency $f_C$ of the charging member are excessively apart from each other, and hence the effects of the present disclosure are not exhibited. In FIG. 8, the two reaction frequencies are excessively close to each other, and hence the effects of the present disclosure are not exhibited. Meanwhile, in FIG. 9, the ratio between the two reaction frequencies falls within a required range, and hence the effects of the present disclosure are exhibited.

Now, a relationship between the impedance and the reaction frequency is described.

When the impedance of a sample is measured, an equivalent circuit can be substantially expressed by a parallel circuit of an electric resistance R (Ω) corresponding to a resistance component and an electrostatic capacitance C (Ω) corresponding to a capacitance component (hereinafter sometimes referred to as "RC parallel circuit"). An impedance Z (Ω) of the sample and an absolute value |Z| (Ω) of impedance are respectively represented by the following expressions (E1) and (E2):

$$Z = \frac{R}{1 + i2\pi fRC} \quad \text{(E1)}$$

$$|Z| = \frac{R}{\sqrt{1 + (2\pi fRC)^2}} \quad \text{(E2)}$$

in the expressions (E1) and (E2), "i" represents an imaginary unit, and "f" represents a frequency (Hz).

In addition, when a polar coordinate display of Z is considered, Z can be represented by the following expression (E3) through use of a phase θ.

$$Z=|Z|e^{i\theta} \quad \text{(E3)}$$

When the phase θ is represented as a function of the frequency "f" from the above-mentioned expressions, the following expression (E4) is established.

$$\theta=\tan^{-1}(2\pi fRC) \quad \text{(E4)}$$

Figure 3:
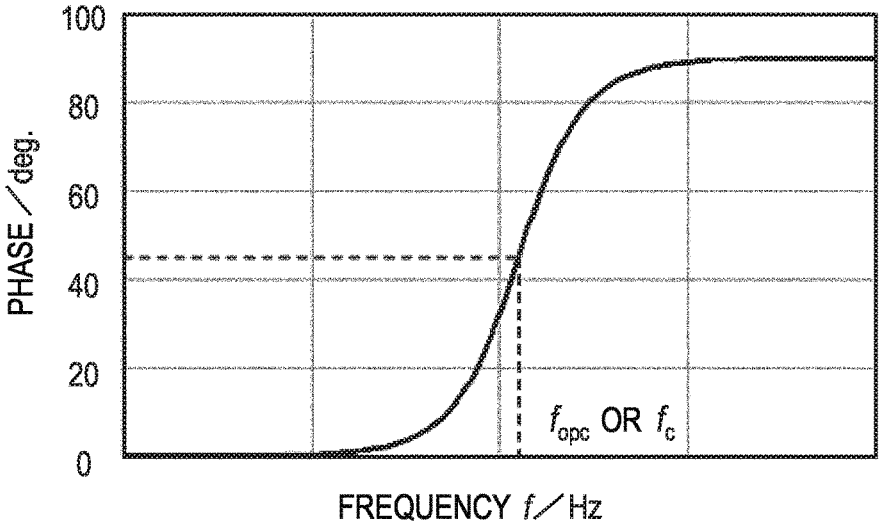
FIG. 3 is an explanatory graph showing impedance characteristics required in the present disclosure.

In FIG. 3, there is shown an f–θ graph of the expression (E4). In the case of an RC parallel circuit model shown in FIG. 3, R and C are constants specific to each sample. Therefore, when θ=0°, f=0 is established. In the impedance in this case, a resistance component becomes dominant. Meanwhile, when θ=90°, f→∞ is established. In the impedance in this case, a capacitance component becomes dominant. The RC parallel circuit at θ=45° is in a transition period of two components of the resistance R and the electrostatic capacitance C, and has high reactivity. In the present disclosure, a frequency corresponding to θ=45° is referred to as "reaction frequency". The phrase "has high reactivity" as used herein refers to the characteristics in which, for example, when a portion, which is locally low resistant, caused by sticking of conductive foreign matter to the surface of the photosensitive member, dent thereof, and the like plunges into a charging process portion, and a shared voltage applied to the photosensitive member is abruptly changed, a large electric load is applied to the charging member or the photosensitive member along with the abrupt change in shared voltage.

The inventors presume the reason why a combination of the photosensitive member and the charging member is effective for suppressing the lateral running while maintaining satisfactory potential fluctuation as described below.

First, when the photosensitive member includes the lowermost layer, the complete exposure of the first support can be suppressed even when sticking of conductive foreign matter to the photosensitive layer and dent thereof occur to locally damage the photosensitive layer. Therefore, a large electric current generated between the first support of the photosensitive member and the charging roller through a local damaged portion in a charging process is stopped by the lowermost layer, with the result that the lateral running can be suppressed.

Second, due to the sea-island structure of the second conductive layer, in which the matrix has a certain resistance or more as compared to that of the domains, discharge to the surface of the photosensitive member is performed mainly from the domains in the charging process. Further, the discharge in the plurality of domains is electrically separated by the matrix, and hence the growth of discharge through a combination of each discharge is suppressed. With this, even when the photosensitive member is locally damaged to reduce the electric resistance, a flow of a large electric current thereto is suppressed. As a result, the insufficient discharge to the surface of the photosensitive member caused by the insufficient supply of electric charge to the charging roller is suppressed, with the result that a linear charging defect in the longitudinal direction of the charging roller, that is, the lateral running is suppressed.

Third, when the reaction frequency $f_{OPC}$ of the photosensitive member and the reaction frequency $f_C$ of the charging member are set to be apart from each other by a certain level or more, the simultaneous application of a large electric load to the photosensitive member and the charging member at the same time constant in the charging process can be suppressed. When the surface of the photosensitive member is brought close to a contact portion (hereinafter sometimes referred to as "nip") between the photosensitive member and the charging roller along with the rotation of the charging roller, discharge occurs in a minute gap in the vicinity of the nip. When a portion, which is locally low resistant, caused by sticking of conductive foreign matter to the surface of the photosensitive member, dent thereof, and the like plunges into the charging process portion, a large electric current is liable to be abruptly generated on the surface of the photosensitive member, and meanwhile, a shared voltage is liable to be abruptly increased on the surface of the charging member corresponding to the low resistant portion. Thus, the inventors conceive that, when the reaction frequency $f_{OPC}$ of the photosensitive member and the reaction frequency $f_C$ of the charging roller are close to each other, there is a high risk in that the electric loads of both of the photosensitive member and the charging roller may be simultaneously increased to generate a large electric current. When the reaction frequency $f_{OPC}$ of the photosensitive member and the reaction frequency $f_C$ of the charging roller are set to be apart from each other by a certain level or more, a flow of a large electric current to the charging roller and the photosensitive member can be avoided. As a result, the lateral running is suppressed.

On the other hand, when the reaction frequency $f_{OPC}$ and the reaction frequency $f_C$ are set so as not to be apart from each other by a threshold limit value or more, impedance characteristics, such as an electric resistance and an electrostatic capacitance of the photosensitive member, when discharge occurs from the charging member in the charging process are changed to some degree. As a result, various memories accumulated in the photosensitive member by the previous processes, such as exposure and transfer, are alleviated. Therefore, high-quality charging through uniform and stable discharge is performed, and satisfactory image quality can be maintained.

As described above, the lateral running is not controlled by each electric resistance of the lowermost layer of the photosensitive member and the second conductive layer of the charging member, but is controlled by optimizing a combination of the reaction frequencies of the photosensitive member and the charging member. Therefore, the electric resistance for achieving satisfactory potential fluctuation is easily controlled independently. In addition, high-quality charging with the memories in the photosensitive member being alleviated according to the above-mentioned mechanism also contributes to the achievement of satisfactory potential fluctuation.

(Electrophotographic Photosensitive Member)

The electrophotographic photosensitive member in the present disclosure has a feature of including a lowermost layer and a photosensitive layer formed on the lowermost layer. Herein, the lowermost layer means a surface treatment layer, an undercoat layer, or a conductive layer (the conductive layer of the electrophotographic photosensitive member is hereinafter sometimes referred to as "first conductive layer"), which is laminated immediately on the first support, and is formed by subjecting the surface of the first support to electrochemical treatment or the like. The surface treatment layer and the first conductive layer on the surface of the first support are described later. It is preferred that a material forming the lowermost layer be an inorganic substance from the viewpoint of deterioration caused by long-time use.

The reaction frequency $f_{OPC}$ (Hz) when the impedance of the lowermost layer is measured is preferably 5 (Hz) or more, particularly preferably 100 (Hz) or more. When the reaction frequency $f_{OPC}$ is increased, a discharge amount per discharge can be reduced, and the number of times of discharge can be increased. Therefore, the lateral running and the potential fluctuation are also made satisfactory.

In addition, it is preferred that an impedance $z_{OPC}$ per unit area of the lowermost layer at $f_{OPC}/10$ (Hz) be $3.0\times10^5$ ($\Omega\cdot cm^2$) or more, and in particular, is more preferably $1.0\times10^9$ ($\Omega\cdot cm^2$) or less.

The reaction frequency $f_{OPC}$ and the impedance $z_{OPC}$ are controlled by various parameters, such as a material for a resin forming the lowermost layer, a metal oxide and the surface treatment of the metal oxide, a thickness, and a mixture ratio and a dispersion state of the resin and the metal oxide. For example, the reaction frequency $f_{OPC}$ can be controlled by a time constant $\tau$=RC. Herein, R represents a resistance of the lowermost layer, and C represents an electrostatic capacitance of the lowermost layer. In general, when R is increased, a change region of a phase in impedance measurement is shifted to a low-frequency side, and hence the reaction frequency $f_{OPC}$ can be decreased. In addition, also when the electrostatic capacitance C is increased, the same effect is obtained.

A method of producing such electrophotographic photosensitive member is, for example, a method involving: preparing coating liquids for the respective layers to be described later; applying the liquids in a desired order of the layers; and drying the liquids. In this case, examples of the method of applying the coating liquid include dip coating, spray coating, inkjet coating, roll coating, die coating, blade coating, curtain coating, wire bar coating, and ring coating. Of those, dip coating is preferred from the viewpoints of efficiency and productivity.

Now, the respective layers are described.

<First Support>

The first support is preferably a conductive support having conductivity. In addition, examples of the shape of the first support include a cylindrical shape, a belt shape, and a sheet shape. Of those, a cylindrical shape is preferred. In addition, the surface of the first support may be subjected to, for example, blast treatment or cutting treatment to form the surface treatment layer.

A metal, a resin, glass, or the like is preferred as a material for the first support.

Examples of the metal include aluminum, iron, nickel, copper, gold, stainless steel, and alloys thereof. Of those, an aluminum support using aluminum is preferred.

In addition, conductivity may be imparted to the resin or the glass through treatment involving, for example, mixing or coating the resin or the glass with a conductive material.

A surface treatment layer may be formed on the first support by subjecting the surface of the first support to anodization in an acidic liquid containing an oxidant. In this case, in the anodization treatment, for example, an inorganic acid, such as sulfuric acid or chromic acid, and an organic acid, such as oxalic acid or a sulfonic acid, may be used as an electrolytic solution. The conditions, such as an application voltage, an electric current density, a treatment temperature, and a time, may be selected in accordance with the kind of the electrolytic solution and a thickness. In addition, the surface treatment layer subjected to anodization, to be used in the electrophotographic photosensitive member in the present disclosure, may be subjected to sealing treatment after being subjected to electrolytic treatment. As a method for the sealing treatment, hot-water treatment, steam treatment, or treatments using various sealing agents, such as nickel acetate and nickel fluoride, may be used, but it is preferred that the treatment using nickel acetate capable of efficiently sealing minute holes be performed.

In particular, the surface treatment layer formed by subjecting the surface of the first support made of aluminum to anodization under appropriate conditions is referred to as "alumite layer," and the alumite layer may be used as the lowermost layer in the present disclosure by appropriately controlling the above-mentioned treatment conditions.

For example, when the anodization time of the first support is prolonged to increase the resistance R of the alumite layer, the reaction frequency $f_{OPC}$ can be decreased.

<First Conductive Layer>

The conductive layer (the conductive layer of the photosensitive member is hereinafter referred to as "first conductive layer") may be arranged on the first support. The arrangement of the first conductive layer can conceal flaws and irregularities in the surface of the first support, and control the reflection of light on the surface of the first support. The first conductive layer preferably contains conductive particles and a resin.

In particular, the conductive layer may be used as the lowermost layer in the present disclosure by selecting the conductive particles and the resin, and controlling a blending ratio thereof, a dispersion method for the conductive particles in a coating liquid for a first conductive layer, and the like.

A material for the conductive particles is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Of those, a metal oxide is preferably used as the conductive particles, and in particular, titanium oxide, tin oxide, and zinc oxide are more preferably used.

When the metal oxide is used as the conductive particles, the surface of the metal oxide may be treated with a silane coupling agent or the like, or the metal oxide may be doped with an element, such as phosphorus or aluminum, or an oxide thereof. As the element for doping and the oxide thereof, there are given phosphorus, aluminum, niobium, tantalum, and the like.

When the specific dielectric constant of the conductive particles is controlled by changing the surface treatment method for the conductive particles or the metal oxide to be used, to thereby increase the electrostatic capacitance C of the first conductive layer, the reaction frequency $f_{OPC}$ can be decreased.

In addition, each of the conductive particles may be of a laminated construction having a core particle and a coating layer coating the particle. Examples of the core particle include titanium oxide, barium sulfate, and zinc oxide. The coating layer is, for example, a metal oxide, such as tin oxide or titanium oxide.

In addition, when the metal oxide is used as the conductive particles, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin.

In addition, the first conductive layer may further contain a concealing agent, such as a silicone oil, resin particles, or titanium oxide.

The first conductive layer has an average thickness of preferably 1 μm or more and 50 μm or less, particularly preferably 3 μm or more and 40 μm or less.

The first conductive layer may be formed by preparing a coating liquid for a first conductive layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. As a dispersion method for dispersing the conductive particles in the coating liquid for a first conductive layer, there are given methods using a paint shaker, a sand mill, a ball mill, and a liquid collision-type high-speed disperser.

<Undercoat Layer>

The undercoat layer may be arranged on the first support or the first conductive layer. The arrangement of the undercoat layer can improve an adhesive function between layers to impart a charge injection-inhibiting function.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, a conductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

In addition, the undercoat layer may further contain an additive.

The undercoat layer has an average thickness of preferably 0.1 μm or more and 50 μm or less, more preferably 0.2 μm or more and 40 μm or less, particularly preferably 0.3 μm or more and 30 μm or less.

The undercoat layer may be formed by preparing a coating liquid for an undercoat layer containing the above-mentioned materials and a solvent, forming a coat thereof, and drying and/or curing the coat. Examples of the solvent to be used for the coating liquid include an alcohol-based solvent, a ketone-based solvent, an ether-based solvent, an ester-based solvent, and an aromatic hydrocarbon-based solvent.

<Photosensitive Layer>

The photosensitive layers of electrophotographic photosensitive members are mainly classified into (1) a laminated photosensitive layer and (2) a single-layer photosensitive layer. (1) The laminated photosensitive layer has a charge-generating layer containing a charge-generating substance and a charge-transporting layer containing a charge-transporting substance. (2) The single-layer photosensitive layer has a photosensitive layer containing both a charge-generating substance and a charge-transporting substance.

(1) Laminated Photosensitive Layer

The laminated photosensitive layer includes the charge-generating layer and the charge-transporting layer.

(1-1) Charge-Generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The charge-generating layer has an average thickness of preferably 0.10 or more and 1.00 μm or less, more preferably 0.15 μm or more and 0.40 μm or less.

The charge-generating layer may be formed by preparing a coating liquid for a charge-generating layer containing the above-mentioned materials and a solvent, forming a coat thereof, and drying the coat. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

(1-2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer has an average thickness of 5 μm or more and 50 μm or less, more preferably 8 μm or more and 40 μm or less, particularly preferably 10 μm or more and 30 μm or less.

The charge-transporting layer may be formed by preparing a coating liquid for a charge-transporting layer containing the above-mentioned materials and a solvent, forming a coat thereof, and drying the coat. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

(2) Single-Layer Photosensitive Layer

The single-layer photosensitive layer may be formed by preparing a coating liquid for a photosensitive layer containing the charge-generating substance, the charge-transporting substance, a resin, and a solvent, forming a coat thereof, and drying the coat. Examples of the charge-generating substance, the charge-transporting substance, and the resin are the same as those of the materials in the section "(1) Laminated Photosensitive Layer."

<Protective Layer>

In the present disclosure, a protective layer may be arranged on the photosensitive layer. The arrangement of the protective layer can improve durability.

The protective layer preferably contains the conductive particles and/or the charge-transporting substance, and a resin.

Examples of the conductive particles include particles of metal oxides, such as titanium oxide, zinc oxide, tin oxide, and indium oxide.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

Examples of the resin include polyester, an acrylic resin, a phenoxy resin, polycarbonate, polystyrene, a phenol resin, a melamine resin, and an epoxy resin. Of those, polycarbonate, polyester, and an acrylic resin are preferred.

In addition, the protective layer may be formed as a cured film by polymerizing a composition containing a monomer having a polymerizable functional group. As a reaction in this case, there are given, for example, a thermal polymerization reaction, a photopolymerization reaction, and a radiation polymerization reaction.

Examples of the polymerizable functional group of the monomer having a polymerizable functional group include an acrylic group and a methacrylic group. A material having a charge-transporting ability may be used as the monomer having a polymerizable functional group.

The protective layer may contain an additive, such as an antioxidant, a UV absorber, a plasticizer, a leveling agent, a lubricity-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The protective layer has an average thickness of preferably 0.5 μm or more and 10 μm or less, more preferably 1 μm or more and 7 μm or less.

The protective layer may be formed by preparing a coating liquid for a protective layer containing the above-mentioned materials and a solvent, forming a coat thereof, and drying and/or curing the coat. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

<Method of Measuring Impedance of Lowermost Layer>

The impedance of the lowermost layer may be measured by the following method.

In order to eliminate the influence of a contact resistance between the lowermost layer and a measurement electrode in impedance measurement, there is a method involving measuring impedance with two terminals through use of a thin film having a low resistance deposited on the surface of the lowermost layer as an electrode and the first support having conductivity as a ground electrode. As a method of forming the thin film, there may be given methods of forming a metal film, such as metal vapor deposition, sputtering, application of a metal paste, and bonding of a metal tape.

However, when an electrode is directly formed on a specific lowermost layer by those procedures, there is a fear in that the electrode and a solvent in which the electrodes are dispersed may contaminate the lowermost layer. From this viewpoint, it is desired that grounding of the surface of the lowermost layer be a procedure for bringing a needle electrode into abutment against the surface of the lowermost layer. The needle electrode is connected to an impedance measuring device, and the first support side is connected to a ground side of the impedance measuring device. With this, the impedance measuring device can suitably acquire an electric signal from the lowermost layer, and thus impedance measurement can be performed.

It is only required that the impedance measuring device be a device capable of measuring impedance of a frequency band up to $1.0\times10^6$ Hz, such as an impedance analyzer, a network analyzer, or a spectrum analyzer. Of those, an impedance analyzer is preferably used for measuring impedance from an electric resistance region of the lowermost layer.

The measurement conditions of impedance are described. Impedance in a frequency band of from $1.0\times10^{-2}$ Hz to $1.0\times10^{6}$ Hz is measured through use of the impedance measuring device. It is preferred that the measurement be performed under an environment of a temperature of 23° C. and a relative humidity of 50%, and five or more measurement points per frequency digit be provided in order to reduce measurement variation.

Regarding a measurement voltage, measurement may be performed while a DC voltage is applied in consideration of the shared voltage applied to the lowermost layer in an electrophotographic apparatus. Specifically, it is preferred that measurement be performed under superimposed application of a DC voltage of 10 V or less and an oscillation voltage in order to quantify the characteristics of transportation and accumulation of electric charge.

In Examples of the present disclosure, a needle electrode having a diameter of 1 mm was mounted to a distal end of a conductive wire on a high-voltage side of an impedance measuring device (Solartron 1260 and Solartron 1296 manufactured by Solartron), and the needle electrode was perpendicularly brought into abutment against the lowermost layer exposed with an appropriate solvent or the like. A conductive clip was mounted to a conductive wire on a ground side of the impedance measuring device, and a part in which a core of the first support was exposed was pinched to acquire electrical conduction. The surface of the first support was polished with a file, as required, to acquire sufficient electrical conduction. Measurement was performed under superimposed application of a DC voltage of −8 V and an AC voltage having an amplitude of 1 Vpp at a frequency of from $1.0\times10^{-2}$ Hz to $1.0\times10^{6}$ Hz (measurement was performed each for ten points when the frequency was changed by one digit).

(Charging Member)

The charging member in the present disclosure may be, for example, a charging roller including a second conductive layer.

The charging roller may be formed, for example, by a method of producing including the following steps (1) to (4).

Step (1): Step of preparing a rubber mixture for forming domains (hereinafter sometimes referred to as "CMB") containing an electron conductive agents and a second rubber.

Step (2): Step of preparing a rubber mixture for forming a matrix (hereinafter sometimes referred to as "MRC") containing a first rubber.

Step (3): Step of preparing a rubber mixture having a matrix-domain structure by kneading the CMB and the MRC.

Step (4): Step of forming a layer of the rubber mixture prepared in the step (3) on a surface of a second support having conductivity directly or through intermediation of another layer, and curing the layer of the rubber mixture to form a second conductive layer in the present disclosure.

<Second Support>

It is preferred that the second support be a conductive support having conductivity. In addition, as the shape of the second support, there are given a columnar shape, a belt shape, a sheet shape, and the like. Of those, a columnar shape is preferred.

A metal, a resin, glass, or the like is preferred as a material for the second support.

Examples of the metal include aluminum, iron, nickel, copper, gold, stainless steel, and alloys thereof. In addition, those metals may each be subjected to oxidation treatment or plating treatment with chromium, nickel, or the like. As the kind of plating, any one of electroplating and non-electrolytic plating may be used, but non-electrolytic plating is preferred from the viewpoint of dimension stability. As the kind of the non-electrolytic plating to be used here, there may be given nickel plating, copper plating, gold plating, and plating of other various alloys. The thickness of the plating is preferably 0.05 μm or more, and is preferably from 0.1 μm to 30 μm in consideration of the balance between working efficiency and rust-proofing ability. The shape of the columnar shape of the second support may be a solid columnar shape or a hollow columnar shape (cylindrical shape). The outer diameter of the second support falls preferably within a range of from 3 mm to 10 mm.

<Intermediate Layer>

An intermediate layer may be formed between the second support and the second conductive layer. When the intermediate layer is formed, the adhesion function between layers is increased, and the charge supply ability can be controlled.

The intermediate layer is preferably a thin and conductive resin layer, such as a primer, from the viewpoint of rapidly supplying electric charge after consumption of electric charge by discharge in the charging process, to thereby stabilize charging.

As the primer, a known primer may be selected to be used in accordance with a rubber material for forming a second conductive layer, a material for the second support, and the like. As a material for the primer, there are given thermosetting resins and thermoplastic resins, such as a phenol-based resin, a urethane resin, an acrylic resin, a polyester resin, a polyether resin, and an epoxy resin.

<Second Conductive Layer>

The second conductive layer is formed on an outer surface of the second support, and includes a matrix containing a first rubber and a plurality of domains dispersed in the matrix. The domains each contain a second rubber and an electron conductive agent, and the matrix has a volume resistivity $\rho_M$ that is $1.0\times10^{5}$ times or more as large as a volume resistivity $\rho_D$ of the domains. When the volume resistivity $\rho_M$ of the matrix and the volume resistivity $\rho_D$ of the domains have the above-mentioned relationship, the function in which electric charge is temporarily stopped at an interface between the matrix and the domains is exhibited. With this, electric charge is abundantly accumulated in the domains to increase an accumulation amount, and hence the efficiency of transfer of electric charge between the domains is improved. Specifically, when a difference between the volume resistivity $\rho_D$ of the domains and the volume resistivity $\rho_M$ of the matrix is increased, the responsiveness in the conductive layer is improved. Therefore, the reaction frequency is shifted to a high-frequency side.

In addition, from the viewpoint of further clarifying the electric charge contrast on the photosensitive member corresponding to the sea-island structure, it is preferred that the volume resistivity $\rho_M$ of the matrix be $1.0\times10^{12}$ (Ω·cm) or more.

When the volume resistivity $\rho_M$ of the matrix is set to $1.0\times10^{12}$ (Ω·cm) or more, discharge from a matrix portion and inflow of electric charge are significantly suppressed, and the discharge contrast in a discharge region and the electric current contrast in a nip region in the charging process are increased. As a result, the electric charge contrast on the photosensitive member after the charging process, which corresponds to the sea-island structure of the charging roller, can be further clarified. In addition, it is preferred that the impedance $z_C$ per unit area of the charging member at $f_C/10$ (Hz) be $1.0\times10^{6}$ (Q·cm$^2$) (Hz) or more.

The thickness of the conductive layer is not particularly limited as long as the intended function and effect of the charging member are obtained, but the thickness is preferably 1.0 mm or more and 4.5 mm or less.

<Method of Measuring Impedance of Charging Member>

The impedance of the charging member may be measured by the following method.

In order to eliminate the influence of a contact resistance between the charging member and a measurement electrode in impedance measurement, impedance is measured with two terminals through use of a thin film having a low resistance deposited on the surface of the charging member as an electrode and the second support having conductivity as a ground electrode.

As a method of forming the thin film, there may be given methods of forming a metal film, such as metal vapor deposition, sputtering, application of a metal paste, and bonding of a metal tape. Of those, the vapor deposition of a thin film of a metal, such as platinum or palladium, is preferably used to form an electrode from the viewpoint of reducing the contact resistance with a conductive member.

When a metal thin film is formed on the surface of the charging member, it is preferred to use a vacuum vapor deposition device provided with a mechanism capable of holding the charging member, and further with a rotary mechanism with respect to a conductive member having a columnar shape in cross-section in consideration of simplicity and uniformity of the thin film.

It is difficult to connect the metal thin film serving as the above-mentioned measurement electrode and an impedance measuring device in the case of a charging member having a curved surface, such as a circular shape in cross-section, for example, a columnar charging member, and hence it is preferred to use the following method. Specifically, it is only required that a metal thin film electrode having a width of from about 10 mm to about 20 mm be formed in a longitudinal direction of the charging member, a metal sheet be wound around the resultant without any gap, and the metal sheet and the measurement electrode protruding from the impedance measuring device be connected to each other to perform measurement. With this, the impedance measuring device can suitably acquire an electric signal from the second conductive layer of the charging member, and thus impedance measurement can be performed. It is only required that, in measurement of impedance, the metal sheet be a metal sheet having an electric resistance value equivalent to that of a metal portion of a connection cable of the impedance measuring device, and for example, aluminum foil, a metal tape, or the like may be used.

It is only required that the impedance measuring device be a device capable of measuring impedance of a frequency band up to $1.0\times10^{6}$ Hz, such as an impedance analyzer, a network analyzer, and a spectrum analyzer. Of those, an impedance analyzer is preferably used for measuring impedance from an electric resistance region of the charging member.

In measurement of impedance, impedance in a frequency band of from $1.0\times10^{-2}$ Hz to $1.0\times10^{6}$ Hz is measured through use of the impedance measuring device. The measurement is performed under an environment of a temperature of 23° C. and a relative humidity of 50%. It is preferred that five or more measurement points per frequency digit be provided in order to reduce measurement variation.

Regarding a measurement voltage, measurement may be performed while a DC voltage is applied in consideration of a shared voltage applied to the charging member in the electrophotographic apparatus. Specifically, it is preferred that measurement be performed under superimposed application of a DC voltage of 10 V or less and an oscillation voltage in order to quantify the characteristics of transportation and accumulation of electric charge.

In Examples of the present disclosure, first, as pretreatment, a measurement electrode was produced by subjecting the produced charging member to vacuum platinum vapor deposition while rotating the charging member. In this case, an electrode which had a band shape having a width of 1.5 cm in a longitudinal direction and was uniform in a circumferential direction was produced through use of a masking tape. Through formation of the electrode, the influence of a contact resistance between the measurement electrode and the conductive member can be eliminated to the extent possible by the surface roughness of the conductive member. Next, an aluminum sheet was wound around the electrode without any gap, to thereby form a measurement electrode on a conductive member side.

Figure 10:
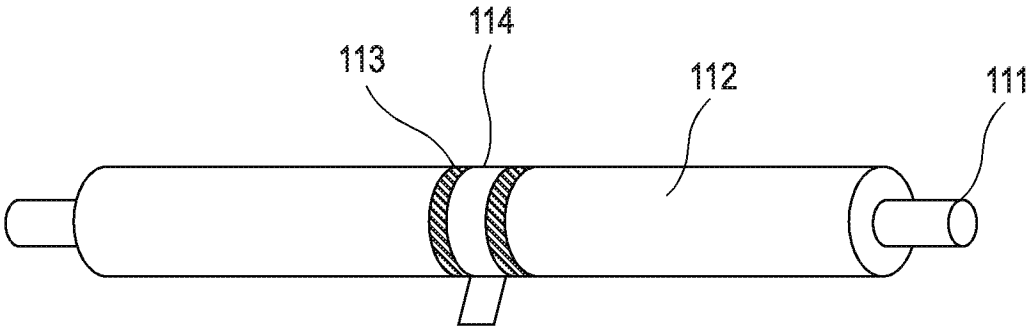
FIG. 10 is a schematic view of a state in which a measurement electrode is formed on a charging roller produced in Examples.

In FIG. 10, there is illustrated a schematic view of a state in which a measurement electrode is formed on a charging roller. In FIG. 10, there are illustrated a second support 111 having conductivity, a second conductive layer 112 having a matrix-domain structure, a platinum vapor deposition layer 113, and an aluminum sheet 114.

Figure 11:
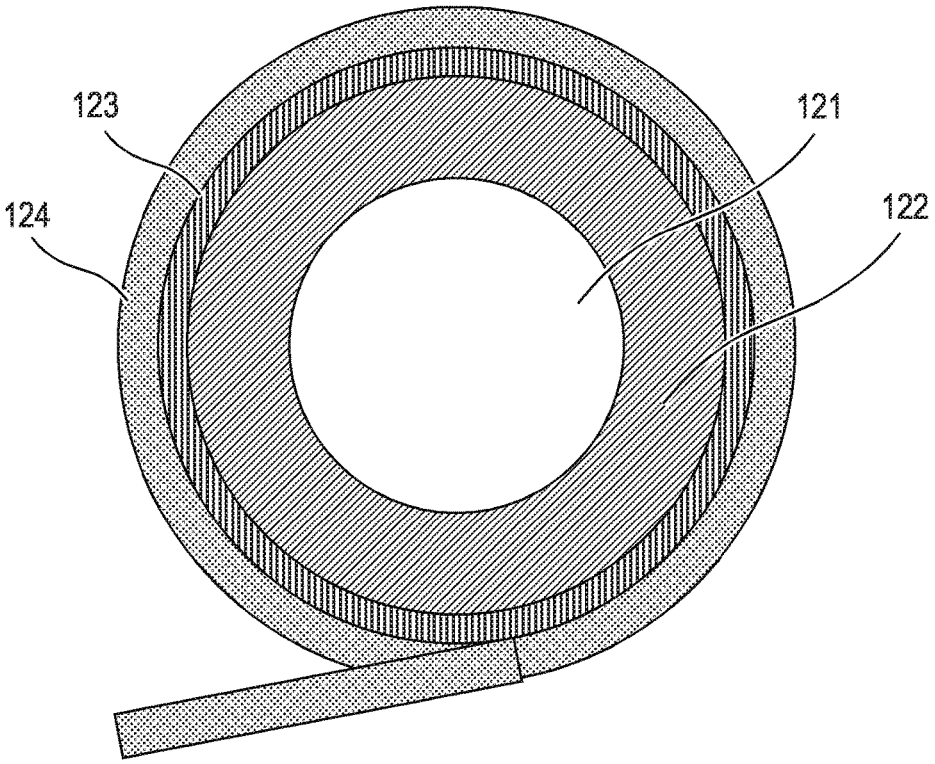
FIG. 11 is a sectional view of a state in which a measurement electrode is formed on a charging roller.

In FIG. 11, there is illustrated a sectional view of a state in which a measurement electrode is formed on a charging roller. There are illustrated a second support 121 having conductivity, a second conductive layer 122 having a matrix-domain structure, a platinum vapor deposition layer 123, and an aluminum sheet 124. As illustrated in FIG. 11, it is important that the second conductive layer 122 having a matrix-domain structure be sandwiched between the second support 121 having conductivity and the measurement electrode.

Figure 12:
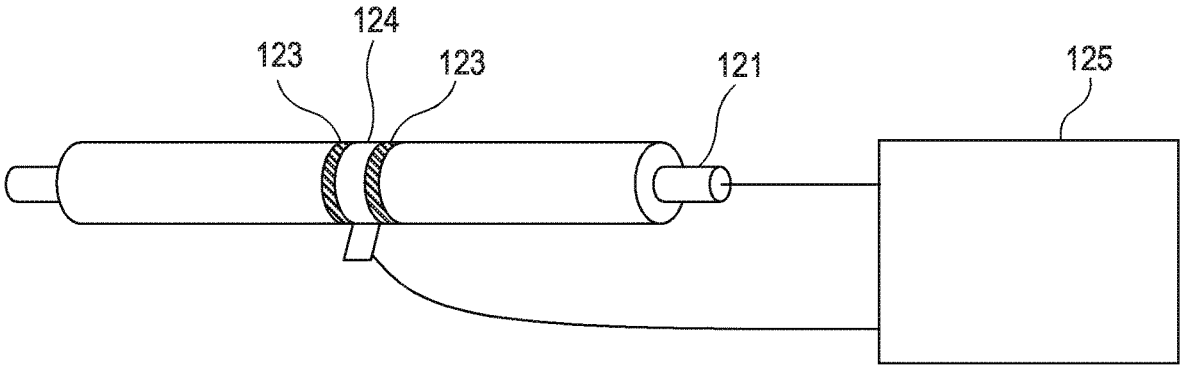
FIG. 12 is a schematic view of an impedance measurement system.

In FIG. 12, there is illustrated a schematic view of the above-mentioned measurement system. The aluminum sheet 124 is connected to a measurement electrode on an impedance measuring device 125 (e.g., Solartron 1260 and Solartron 1296 manufactured by Solartron) side. Impedance measurement is performed through use of the second support 121 having conductivity and the aluminum sheet 124 as two electrodes for the impedance measuring device 125 for measurement.

In measurement of impedance, the charging member is allowed to stand under an environment of a temperature of 23° C. and a relative humidity of 50% for 48 hours, to thereby saturate a moisture amount of the charging member.

Impedance is measured with an AC voltage having an amplitude of 1 Vpp at a frequency of from $1\times10^{-2}$ Hz to $1.0\times10^{6}$ Hz under an environment of a temperature of 23° C. and a relative humidity of 50% (measurement is performed each for five points when the frequency is changed by one digit), to thereby obtain an impedance measurement value.

<Method of Controlling Volume Resistivities $\rho_D$ and $\rho_M$, and Domain-Matrix Structure>

In order to control the volume resistivity $\rho_D$ (Ω·cm) of the domains, the volume resistivity $\rho_M$ (Ω·cm) of the matrix, and the domain-matrix structure of the second conductive layer in the present disclosure, it is only required that the kinds of materials to be used in each of the above-mentioned steps (1) to (4) for producing the charging roller and the contents thereof be selected, and the production conditions be adjusted.

First, the volume resistivity $\rho_D$ of the domains can be controlled by the amount of the electron conductive agent in the CMB.

For example, it is assumed that conductive carbon black having a dibutyl phthalate oil absorption amount (DBP oil absorption amount) of 40 ($cm^3$)/100 (g) or more and 170 ($cm^3$)/100 (g) or less is used as the electron conductive agent. In this case, the volume resistivity $\rho_D$ can be controlled to $1.0\times10^1$ (Ω·cm) or more and $1.0\times10^4$ (Ω·cm) or less by preparing the CMB so that the CMB contains the conductive carbon black in an amount of 40 mass % or more and 200 mass % or less based on the total mass of the CMB.

As a rubber material for domains, a rubber composition containing a rubber component for a matrix may be used. From the viewpoint of ease of formation of a sea-island structure, a difference in SP value between the rubber material for domains and the rubber material forming the matrix is preferably 0.4 ($(J/cm^3)^{0.5}$) or more and 5.0 ($(J/cm^3)^{0.5}$) or less, more preferably 0.4 ($(J/cm^3)^{0.5}$) or more and 2.2 ($(J/cm^3)^{0.5}$) or less.

The volume resistivity of the domains can be adjusted by appropriately selecting the kind of the electron conductive agent and the addition amount thereof. As the electron conductive agent to be blended with the domains, there are given, for example, carbon black, graphite, oxides, such as titanium oxide and tin oxide, and particles that are made conductive through coating of a surface with a metal, such as Cu or Ag, or a metal oxide thereof. In addition, as required, two or more kinds of those conductive agents may be blended in an appropriate amount to be used.

Of the above-mentioned electron conductive agents, conductive carbon black, which has large affinity with a rubber and with which the distance between electron conductive agents is easily controlled, is preferably used. Examples of the carbon black to be blended with the domains include, but are not limited to, gas furnace black, oil furnace black, thermal black, lamp black, acetylene black, and ketjen black.

Of those, from the viewpoint of being capable of imparting high conductivity to the domains, conductive carbon black having a DBP oil absorption amount of 40 ($cm^3$)/100 (g) or more and 170 ($cm^3$)/100 (g) or less can be preferably used.

It is preferred that the electron conductive agent, such as conductive carbon black, be blended with the domains in an amount of 20 parts by mass or more and 150 parts by mass or less with respect to 100 parts by mass of the rubber component contained in the domains. A particularly preferred blending ratio is 50 parts by mass or more and 100 parts by mass or less. In blending of the conductive agent in those ratios, it is preferred that the conductive agent be blended in a large amount as compared to that of a general electrophotographic charging member.

In addition, as required, a filler, a processing aid, a cross-linking aid, a cross-linking accelerator, an age resistor, a cross-linking accelerator activator, a cross-linking retarder, a softening agent, a dispersant, a colorant, or the like, which is generally used as a compounding agent for a rubber, may be added to the rubber composition for the domains to the extent that the effects of the present disclosure are not impaired.

Next, the volume resistivity $\rho_M$ of the matrix can be controlled by the composition of the MRC.

For example, examples of the first rubber to be used for the MRC include a natural rubber, a butadiene rubber, a butyl rubber, an acrylonitrile-butadiene rubber, a urethane rubber, a silicone rubber, a fluorine rubber, an isoprene rubber, a chloroprene rubber, a styrene-butadiene rubber, an ethylene-propylene rubber, and a polynorbornene rubber each having low conductivity.

In addition, a filler, a processing aid, a cross-linking agent, a cross-linking aid, a cross-linking accelerator, a cross-linking accelerator activator, a cross-linking retarder, an age resistor, a softening agent, a dispersant, or a colorant may be added to the MRC as required.

Meanwhile, it is preferred that the electron conductive agent, such as carbon black, be not contained in the MRC in order to satisfy $\rho_M/\rho_D\geq10^5$ and $\rho_M\geq1.0\times10^{12}$.

Finally, the domain-matrix structure can be effectively controlled by adjusting the following four conditions (a) to (d).

(a) A difference between surface tensions σ of the CMB and the MRC.

(b) A ratio $\eta_D/\eta_M$ between a viscosity $\eta_D$ of the CMB and a viscosity $\eta_M$ of the MRC.

(c) A shear rate γ at the time of kneading of the CMB and the MRC and an energy amount EEK at the time of shearing in the production step (3) of the charging roller.

(d) CMB volume fraction to the MRC in the production step (3) of the charging roller.

Now, each step is described.

(a) Interface Tension Difference of CMB and MRC

In general, when two kinds of immiscible rubbers are mixed with each other, phase separation occurs. The reason for this is as described below. The interaction between similar polymers is stronger than that between dissimilar polymers, and hence the similar polymers are aggregated with each other to decrease free energy, thereby being stabilized. The interface of a phase separation structure is brought into contact with the dissimilar polymers, and hence the free energy thereof becomes higher than that of the inside that is stabilized due to the interaction between the similar polymers. As a result, interface tension for reducing an area that is brought into contact with the dissimilar polymers is generated in order to reduce the free energy of the interface. When the interface tension is small, even the dissimilar polymers attempt to be uniformly mixed with each other in order to increase entropy. A uniformly mixed state refers to dissolution, and a solubility parameter (hereinafter referred to as "SP value") serving as a guideline for solubility and the interface tension tend to correlate with each other.

Specifically, it is conceived that the difference between surface tensions a of the CMB and the MRC correlate with an SP value difference of rubbers contained in the CMB and the MRC. It is preferred that, as a first rubber in the MRC and a second rubber in the CMB, rubbers having a difference of absolute values of SP values of 0.4 ($(J/cm^3)^{0.5}$) or more and 5.0 ($(J/cm^3)^{0.5}$) or less, in particular, 0.4 ($(J/cm^3)^{0.5}$) or more and 2.2 ($(J/cm^3)^{0.5}$) or less be selected. Within those ranges, a stable phase separation structure can be formed, and in addition, each domain diameter of the CMB can be reduced.

Herein, specific examples of the second rubber that may be used for the CMB include a natural rubber (NR), an isoprene rubber (IR), a butadiene rubber (BR), a styrene-butadiene rubber (SBR), a butyl rubber (IIR), an ethylene-propylene rubber (EPM, EPDM), a chloroprene rubber (CR), a nitrile rubber (NBR), a hydrogenated nitrile rubber (H-NBR), a silicone rubber, and a urethane rubber (U).

(b) Viscosity Ratio of CMB and MRC

When the viscosity ratio $\eta_D/\eta_M$ of the CMB and the MRC is closer to 1, the maximum Feret diameter of the domains can be reduced. Specifically, it is preferred that the viscosity ratio $\eta_D/\eta_M$ satisfy $1.0\leq\eta_D/\eta M\leq2.0$. The viscosity ratio $\eta_D/\eta_M$ can be adjusted by selecting the Mooney viscosity of raw material rubbers to be used in the CMB and the MRC, and selecting the kind and blending amount of a filler. In addition, the viscosity ratio $\eta_D/\eta_M$ can be adjusted also by adding a plasticizer, such as paraffin oil, to such a degree as not to hinder the formation of the phase separation structure. In addition, the viscosity ratio $\eta_D/\eta_M$ can be adjusted also by adjusting the temperature at the time of kneading. Each viscosity of the rubber mixture for forming domains and the rubber mixture for forming a matrix are obtained by measuring a Mooney viscosity ML (1+4) at a rubber temperature at the time of kneading in accordance with JIS K 6300-1: 2013.

(c) Shear Rate at Time of Kneading of CMB and MRC and Energy Amount at Time of Shearing When the shear rate $\gamma$ at the time of kneading of the CMB and the MRC is higher, and when the energy amount EEK at the time of shearing is larger, an interdomain distance can be reduced.

The shear rate $\gamma$ can be increased by increasing an inner diameter of a stirring member, such as a blade or a screw, of a kneader to reduce a gap from an end surface of the stirring member to an inner wall of the kneader or by increasing the rotation number of the stirring member. In addition, the energy amount EEK can be increased by increasing the rotation number of the stirring member or by increasing each viscosity of the second rubber in the CMB and the first rubber in the MRC.

(d) CMB Volume Fraction to MRC

The volume fraction of the CMB to the MRC correlates with the collision coalescence probability of the CMB. Specifically, when the volume fraction of the CMB to the MRC is reduced, the collision coalescence probability of the CMB is decreased. That is, when the volume fraction of the CMB to the MRC is reduced within a range in which required conductivity is obtained, the interdomain distance can be reduced. From this viewpoint, it is preferred that the volume fraction of the CMB to the MRC be 15% or more and 40% or less.

The second conductive layer satisfying $\mu_M/\rho_D \geq 10^5$ and $\rho_M \geq 1.0\times10^{12}$ can be obtained by forming a sea-island structure while controlling the volume resistivities pi and $\rho_M$ through use of the above-mentioned method.

<Method of Identifying Sea-Island Structure>

The presence of the sea-island structure in the second conductive layer can be identified by producing a slice from the second conductive layer and observing the detail of a fracture surface formed in the slice.

As a device for forming a slice, there are given, for example, a sharp razor, a microtome, and a focused ion beam (FIB). In addition, in order to observe the sea-island structure more accurately, a slice for observation may be subjected to pretreatment that enables contrast between domains and a matrix to be suitably obtained, such as dyeing treatment or vapor deposition treatment.

The presence of the sea-island structure can be identified by observing the fracture surface of the slice having the fracture surface formed thereon, which has been subjected to the pretreatment as required, with a laser microscope, a scanning electron microscope (SEM), a transmission electron microscope (TEM). From the viewpoint that the sea-island structure can be identified simply and accurately, it is preferred that the sea-island structure be observed with the SEM.

A slice of the second conductive layer is obtained by the above-mentioned procedure, and the surface of the slice is observed with a magnification of from 1,000 times to 10,000 times to obtain an image. After that, the image is converted into an 8-bit grayscale image through use of image processing software (product name: Image-Pro Plus, manufactured by Media Cybernetics Inc.) or the like, to thereby obtain a monochromatic image of 256-level gray scale. Then, the image is subjected to black/white inversion so that the domains in the fracture surface become white. After that, a binarization threshold value is set to the brightness distribution of the image based on an algorithm of Otsu's discriminant analysis method, to thereby obtain a binarized image. Finally, it is only required that the presence or absence of a matrix-domain structure be determined based on the analysis image which has been subjected to image processing to a state in which the domains and the matrix are discriminated from each other by binarization.

When the analysis image includes a structure in which the plurality of domains **6*b* are present in an isolated state in the matrix 6*a* as illustrated in FIG. 2, the presence of the sea-island structure in the second conductive layer can be identified. It is only required that the isolated state of the domains 6*b* be a state in which each of the domains 6*b* is arranged so as not to be connected to another domain 6*b*, and that the matrix 6*a* is contiguous within the image so that the domains 6*b* are separated from each other by the matrix 6*a***. Specifically, when a region measuring 50 (μm) per side in the analysis image is assumed to be an analysis region, a state in which the number of the domains present in an isolated state as described above is a number percentage of 80 or more with respect to the total number of a group of domains that do not have a contact point with a frame border of the analysis region is defined as a state having a sea-island structure.

It is only required that the above-mentioned identification be performed by equally dividing the second conductive layer of the conductive member into five regions in a longitudinal direction, equally dividing each of the regions into four regions in a circumferential direction, producing segments from a total of 20 points with one segment being arbitrarily obtained from each of the regions, and performing the above-mentioned measurement.

In Examples of the present disclosure, a segment was cut out through use of a razor so that a cross-section perpendicular to the longitudinal direction of the second conductive layer was able to be observed. The segment was subjected to platinum vapor deposition, and the resultant was photographed with a magnification of 1,000 times through use of a scanning electron microscope (SEM) (product name: 5-4800, manufactured by Hitachi High-Technologies Corporation) to obtain a tomographic image.

Subsequently, in Examples of the present disclosure, in the binarized image obtained through use of the above-mentioned image processing software and method, a number percentage K of the domains **6*b* isolated without being connected to each other was calculated by a count function with respect to the total number of the domains 6*b* which were present in a region measuring 50 μm per side and which did not have a contact point with a frame border of the binarized image. In this case, as illustrated in FIG. 2, there was identified a group of domains in which the plurality of domains 6*b* were dispersed in the matrix 6*a* and were present in such an independent state that the domains 6*b* were not connected to each other, while the matrix 6*a*** was contiguous within the image.

Finally, in Examples of the present disclosure, the presence or absence of the sea-island structure was determined as described below. Specifically, the second conductive layer was equally divided into five regions in a longitudinal direction, and each of the regions was equally divided into four regions in a circumferential direction. Segments were produced from a total of 20 points with one segment being arbitrarily obtained from each of the obtained regions, and the above-mentioned measurement was performed. Then, when an arithmetic average value K (number percentage) thus obtained was 80 or more, it was evaluated that the sea-island structure was "present". When the arithmetic average value K (number percentage) was less than 80, it was evaluated that sea-island structure was "absent".

<Method of Measuring Volume Resistivity $\rho_D$ of Domains>

The volume resistivity $\rho_D$ of the domains may be measured by forming a slice from the second conductive layer and measuring the volume resistivity $\rho_D$ thereof with a minute probe. As a device for forming a slice, there are given, for example, a sharp razor, a microtome, and a focused ion beam (FIB).

When a slice is formed, it is required to eliminate the influence of the matrix and measure the volume resistivity of only the domains. Therefore, it is required to form a slice having a thickness smaller than the interdomain distance measured with a scanning electron microscope (SEM), a transmission electron microscope (TEM), or the like in advance. Thus, as a device for forming a slice, a device capable of producing an extremely thin sample, such as a microtome, is preferred.

The volume resistivity is measured as described below. First, one surface of the slice is grounded, and then, the positions of the matrix and the domains in the slice are specified. The positions may be specified by a device capable of measuring a distribution of the volume resistivity or hardness of the matrix and the domains, such as a scanning probe microscope (SPM) or an atomic force microscope (AFM). Then, a probe is brought into contact with the matrix, and a DC voltage of 1 (V) is applied to the matrix for 5 seconds to measure an arithmetic average value of ground current values for 5 seconds. The application voltage is divided by the measurement value to calculate an electric resistance value. Finally, it is only required that the resistance value be converted into a volume resistivity through use of the thickness of the slice. In this case, a device capable of performing shape measurement, such as the SPM and the AFM, is preferred because the thickness of the slice can also be measured simultaneously with the resistance value.

The volume resistivity $\rho_D$ of the columnar charging member may be measured by cutting out one slice sample from each of regions obtained by dividing the second conductive layer into four regions in a circumferential direction and dividing each of the regions into five regions in a longitudinal direction, obtaining the above-mentioned measurement value, and then calculating an arithmetic average value of volume resistivities of a total of 20 samples.

In Examples, an extremely thin segment having a thickness of 1 μm was cut out from the second conductive layer at a cutting temperature of −100° C. through use of a microtome (product name: Leica EM FCS, manufactured by Leica Microsystems). When a long thin segment was cut out, cutting was performed in a direction of a cross-section perpendicular to a longitudinal direction of the charging member in consideration of a direction in which electric charge was transported for discharge.

Next, in Examples, the extremely thin segment was placed on a metal plate under an environment of a temperature of 23° C. and a relative humidity of 50%, and a region that was brought into direct contact with the metal plate was selected. Then, a cantilever of a scanning probe microscope (SPM) (product name: Q-Scope 250, manufactured by Quesant Instrument Corporation) was brought into contact with portions corresponding to the domains. A voltage of 1 V was applied to the cantilever for 5 seconds to measure current values, to thereby calculate an arithmetic average value for 5 seconds.

Subsequently, in Examples of the present disclosure, the surface shape of the measurement segment was observed with the SPM, and the thickness of the measurement portion was calculated from an obtained height profile. Further, from the observation results of the surface shape, a recess area of the contact portion of the cantilever was calculated. A volume resistivity was calculated from the thickness and the recess area.

Finally, in Examples of the present disclosure, the above-mentioned measurement was performed by producing segments from a total of 20 points, with one segment being arbitrarily produced from each of regions obtained by equally dividing the second conductive layer into five regions in a longitudinal direction and equally dividing each of the regions into four regions in a circumferential direction. An average value thereof was defined as the volume resistivity $\rho_D$ of the domains.

In Examples of the present disclosure, scanning was performed with the SPM in a contact mode.

<Method of Measuring Volume Resistivity $\rho_M$ of Matrix>

The volume resistivity $\rho_M$ of the matrix may be measured by the same method as the above-mentioned <Method of Measuring Volume Resistivity $\rho_D$ of Domains> except that the measurement portion is changed to a portion corresponding to the matrix, and the application voltage at the time of measurement of the current value is changed to 50 V.

In Examples of the present disclosure, the volume resistivity $\rho_M$ of the matrix was measured by the same method as the method in Examples of the present disclosure in the above-mentioned <Method of Measuring Volume Resistivity $\rho_D$ of Domains> except that the measurement portion was changed to a portion corresponding to the matrix, and the application voltage at the time of measurement of the current value was changed to 50 V.

<Method of Measuring SP Value>

An SP value can be calculated with satisfactory accuracy by creating a calibration curve through use of a material having a known SP value. As the known SP value, a catalog value of a material manufacturer may also be used. For example, NBR and SBR are each substantially determined for an SP value based on each content ratio of acrylonitrile and styrene without depending on the molecular amount. Thus, through use of an analysis procedure, such as pyrolysis gas chromatography (Py-GC) or solid-state nuclear magnetic resonance (NMR) spectroscopy, with respect to rubbers forming the matrix and the domains, the content ratio of acrylonitrile or styrene is analyzed, and an SP value can be calculated based on the content ratio together with a calibration curve obtained from a material having a known SP value. In addition, an isoprene rubber is determined for an SP value from an isomeric structure, such as 1,2-polyisoprene, 1,3-polyisoprene, 3,4-poisoprene, cis-1,4-polyisoprene, and trans-1,4-polyisoprene. Thus, in the same manner as in the SBR and the NBR, an isomer content ratio is analyzed by the Py-GC, the solid-state NMR spectroscopy, or the like, and an SP value can be calculated based on the isomer content ratio together with a calibration curve obtained from a material having a known SP value. The SP value of a material having a known SP value is determined by a Hansen solubility sphere method.

(Process Cartridge and Electrophotographic Apparatus)

A process cartridge of the present disclosure has a feature of integrally supporting the electrophotographic photosensitive member and the charging member described in the foregoing and being removably mounted onto the main body of an electrophotographic apparatus. The process cartridge according to the present disclosure may integrally support at least one unit selected from the group consisting of a developing unit, a transferring unit, and a cleaning unit.

In addition, an electrophotographic apparatus of the present disclosure has a feature of including the electrophotographic photosensitive member and the charging member described in the foregoing, and an exposing unit, a developing unit, and a transferring unit.

It is preferred that, in the photosensitive member and the charging member included in the process cartridge of the present disclosure, a relationship $f_{OPC}/f_C$ of the reaction frequency $f_{OPC}$ (Hz) of the photosensitive member and the reaction frequency $f_C$ (Hz) of the charging member satisfy one of the following expression (D3) and the following expression (D4).

$$30 \leq f_{OPC}/f_C \leq 3{,}000 \quad \text{Expression (D3)}$$

$$0.0003 \leq f_{OPC}/f_C \leq 0.03 \quad \text{Expression (D4)}$$

Further, from the viewpoint of suppressing the lateral running by achieving a balance in electric resistance between the photosensitive member and the charging member, it is preferred that the impedance $z_{OPC}$ ($\Omega \cdot cm^2$) per unit area of the lowermost layer at $f_{OPC}/10$ (Hz) and the impedance $z_C$ ($\Omega \cdot cm^2$) per unit area of the charging member at $f_C/10$ (Hz) satisfy the relationship of the following expression (D5).

$$(z_{OPC} \times z_C) \geq 1.0 \times 10^6 \quad \text{Expression (D5)}$$

Figure 1:
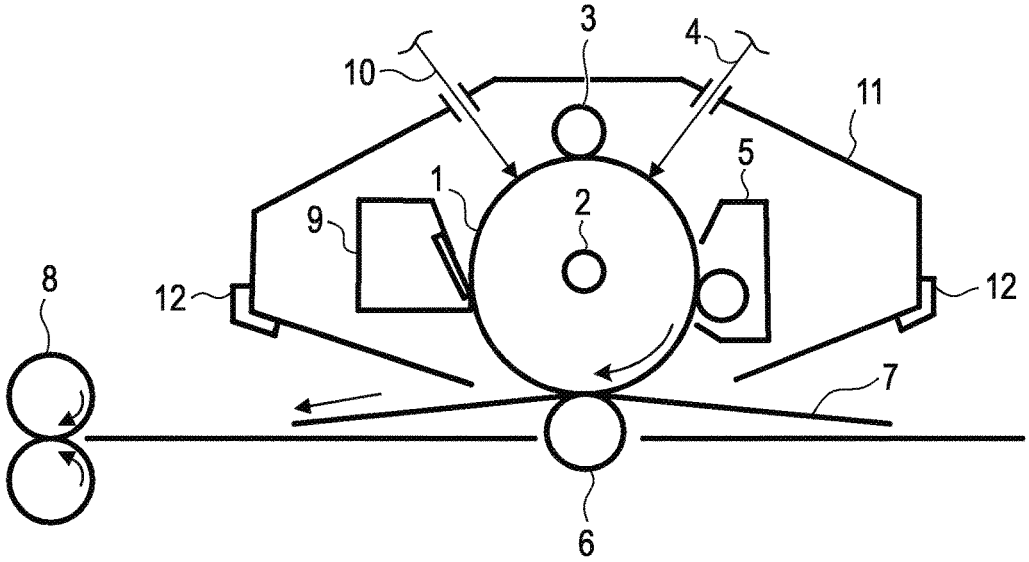
FIG. 1 is a view for illustrating an example of a schematic configuration of an electrophotographic apparatus including a process cartridge including an electrophotographic photosensitive member and a charging member.

An example of the schematic construction of an electrophotographic apparatus including a process cartridge including an electrophotographic photosensitive member and a charging member is illustrated in FIG. 1.

A cylindrical electrophotographic photosensitive member 1 is rotationally driven about a shaft 2 in a direction indicated by the arrow at a predetermined peripheral speed. The surface of the electrophotographic photosensitive member 1 is charged to a predetermined positive or negative potential by a charging member 3. As illustrated in FIG. 1, the charging member in the present disclosure has a roller charging system based on a roller-type charging member. The charged surface of the electrophotographic photosensitive member 1 is irradiated with exposure light 4 from an exposing unit (not shown), and hence an electrostatic latent image corresponding to target image information is formed thereon. The electrostatic latent image formed on the surface of the electrophotographic photosensitive member 1 is developed with a toner stored in a developing unit 5, and a toner image is formed on the surface of the electrophotographic photosensitive member 1. The toner image formed on the surface of the electrophotographic photosensitive member 1 is transferred onto a transfer material 7 by a transferring unit 6. The transfer material 7 onto which the toner image has been transferred is conveyed to a fixing unit 8, is subjected to treatment for fixing the toner image, and is printed out to the outside of the electrophotographic apparatus. The electrophotographic apparatus may include a cleaning unit 9 for removing a deposit, such as the toner remaining on the surface of the electrophotographic photosensitive member 1 after the transfer. In addition, a so-called cleaner-less system configured to remove the deposit with the developing unit or the like without separate arrangement of the cleaning unit may be used. The electrophotographic apparatus may include an electricity-removing mechanism configured to subject the surface of the electrophotographic photosensitive member 1 to electricity-removing treatment with pre-exposure light 10 from a pre-exposing unit (not shown). In addition, a guiding unit 12, such as a rail, may be arranged for removably mounting a process cartridge 11 of the present disclosure onto the main body of an electrophotographic apparatus.

The electrophotographic photosensitive member can be used in, for example, a laser beam printer, an LED printer, a copying machine, a facsimile, and a multifunctional peripheral thereof.

According to one aspect of the present disclosure, the process cartridge capable of suppressing the lateral running while maintaining satisfactory potential fluctuation can be obtained. In addition, according to another aspect of the present disclosure, the electrophotographic apparatus capable of forming a high-quality electrophotographic image can be obtained.

EXAMPLES

The present disclosure is described in more detail below by way of Examples and Comparative Examples. The present disclosure is by no means limited to the following Examples, and various modifications may be made without departing from the gist of the present disclosure. In the description in the following Examples, "part(s)" is by mass unless otherwise specified.

The thickness of each layer of an electrophotographic photosensitive member of each of Examples and Comparative Examples, except for a charge-generating layer, was determined by a method using an eddy current thickness meter (product name: Fischerscope, manufactured by Fischer Instruments K.K.) or a method involving performing specific gravity conversion from a mass per unit area. The thickness of the charge-generating layer was measured by converting a Macbeth density value of a photosensitive member through use of a calibration curve obtained in advance from the Macbeth density value measured by pressing a spectral densitometer (product name: X-Rite 504/508, manufactured by X-Rite Inc.) onto the surface of the photosensitive member and a thickness measurement value obtained by sectional SEM image observation.

<Production of Electrophotographic Photosensitive Member>

A first support, a first conductive layer, an undercoat layer, a charge-generating layer, and a charge-transporting layer were produced by the methods described below to produce an electrophotographic photosensitive member. Combinations of a surface treatment layer, the first conductive layer, and the undercoat layer in the produced photosensitive member are shown in Table 1.

<Production of First Support>

An aluminum cylinder (JIS-A3003, aluminum alloy) having a diameter of φ24 mm and a length of 257 mm was obtained by hot extrusion. If required, a surface treatment layer was produced by a method described later to obtain a first support.

(Production of Surface Treatment Layer 1)

The first support was subjected to cutting processing through use of a diamond sintered cutting tool.

In a washing step, the cylinder was subjected to degreasing treatment, etching treatment in a 2 wt % sodium hydroxide solution for 1 minute, neutralization treatment, and further washing with pure water in the stated order.

Next, the resultant was subjected to anodization in a 14 wt % sulfuric acid solution at a DC voltage of 20 V for 10 minutes, to thereby form an anodized film on the surface of the cylinder. Then, after washing with water, the resultant was immersed in a 0.8 wt % nickel acetate solution at a temperature of 72° C. for 15 minutes, to thereby perform sealing treatment. Further, washing with pure water and drying treatment were performed to obtain a surface treatment layer 1.

(Production of Surface Treatment Layer 2)

The first support was subjected to cutting processing through use of a diamond sintered cutting tool.

In a washing step, the cylinder was subjected to degreasing treatment, etching treatment in a 2 wt % sodium hydroxide solution for 1 minute, neutralization treatment, and further washing with pure water in the stated order.

Next, the resultant was subjected to anodization in a 10 wt % sulfuric acid solution at a DC voltage of 15 V for 20 minutes, to thereby form an anodized film on the surface of the cylinder. Then, after washing with water, the resultant was immersed in a 1 wt % nickel acetate solution at a temperature of 80° C. for 15 minutes, to thereby perform sealing treatment. Further, washing with pure water and drying treatment were performed to obtain a surface treatment layer 2.

(Production of Surface Treatment Layer 3)

A surface treatment layer 3 was obtained in the same manner as in the surface treatment layer 2 except that the anodization time was changed to 30 seconds in the production of the surface treatment layer 2.

(Production of Surface Treatment Layer 4)

A surface treatment layer 4 was obtained in the same manner as in the surface treatment layer 2 except that the anodization time was changed to 20 seconds in the production of the surface treatment layer 2.

(Production of Surface Treatment Layer 5)

A surface treatment layer 5 was obtained in the same manner as in the surface treatment layer 2 except that the anodization time was changed to 10 seconds in the production of the surface treatment layer 2.

<Production of First Conductive Layer>

(Conductive Layer 1-1)

60 Parts of tin oxide-coated barium sulfate particles (product name: Passtran PC1, manufactured by Mitsui Mining & Smelting Co., Ltd.), 15 parts of titanium oxide particles (product name: TITANIX JR, manufactured by Tayca Corporation), 43 parts of a resol type phenol resin (product name: PHENOLITE J-325, manufactured by DIC Corporation, solid content: 70 mass %), 0.015 part of a silicone oil (product name: SH28PA, manufactured by Dow Corning Toray Co., Ltd., 3.6 parts of silicone resin particles (product name: TOSPEARL 120, manufactured by Momentive Performance Materials Japan LLC), 50 parts of 2-methoxy-1-propanol, and 50 parts of methanol were placed in a ball mill and subjected to a dispersion treatment for 20 hours, to thereby prepare a coating liquid 1 for a first conductive layer. The coating liquid 1 for a first conductive layer was applied onto the above-mentioned first support by dip coating to form a coat, and the obtained coat was cured by heating at a temperature of 145° C. for 1 hour to form a conductive layer 1-1 having a thickness of 25 μm.

(Conductive Layer 1-2)

100 Parts of zinc oxide particles (manufactured by Tayca Corporation, average primary particle diameter: 50 nm, specific surface area: 19 $m^2/g$, powder resistivity: $4.7\times10^6$ Ω·cm) were mixed with 500 parts of toluene under stirring. To the mixture, 1.25 parts of N-2-(aminoethyl)-3-aminopropylmethyldimethoxysilane (product name: KBM602, manufactured by Shin-Etsu Chemical Co., Ltd.) was added as a surface treatment agent, and the whole was mixed under stirring for 4 hours. After that, toluene was evaporated under reduced pressure, and the residue was dried at a temperature of 130° C. for 4 hours to obtain surface-treated zinc oxide particles.

100 Parts of titanium oxide particles (product name: JR-405, manufactured by Tayca Corporation, average primary particle diameter: 210 nm) were mixed with 500 parts of toluene under stirring. To the mixture, 0.75 part of N-2-(aminoethyl)-3-aminopropylmethyldimethoxysilane was added, and the whole was stirred for 2 hours. After that, toluene was evaporated by distillation under reduced pressure, and the residue was baked at a temperature of 120° C. for 3 hours to obtain surface-treated titanium oxide particles.

(A2)

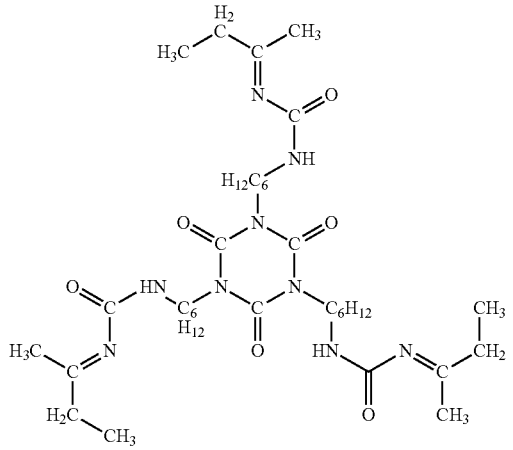

Subsequently, 75 parts of the above-mentioned surface-treated zinc oxide particles, 16 parts of a blocked isocyanate compound represented by the formula (A2) (product name: Sumidur 3175, manufactured by Sumitomo Bayer Urethane Co., Ltd., solid content: 75 mass %), 9 parts of a polyvinyl butyral resin (product name: S-LEC BM-1, manufactured by Sekisui Chemical Co., Ltd.), 1 part of 2,3,4-trihydroxybenzophenone (manufactured by Tokyo Chemical Industry Co., Ltd.), and 8.65 parts of titanium oxide particles subjected to a surface treatment in order to prevent an interference fringe were added to a mixed solvent of 60 parts of methyl ethyl ketone and 60 parts of cyclohexanone to prepare a dispersion liquid. The dispersion liquid was subjected to dispersion treatment under an atmosphere of a temperature of 23° C. at a rotation number of 1,500 rpm for 3 hours with a vertical sand mill through use of glass beads having an average particle diameter of 1.0 mm. After the dispersion treatment, to the obtained dispersion liquid, 5 parts of cross-linked polymethyl methacrylate particles (product name: SSX-103, manufactured by Sekisui Chemical Co., Ltd., average particle diameter: 3 μm) and 0.01 part of a silicone oil (product name: SH28PA, manufactured by Dow Corning Toray Co., Ltd.) were added, followed by stirring, to thereby prepare a coating liquid 2 for a first conductive layer. The coating liquid 2 for a first conductive layer was applied onto the first support by dip coating to form a coat, and the obtained coat was polymerized by heating at a temperature of 160° C. for 40 minutes to form a conductive layer 1-2 having a thickness of 30 μm.

(Conductive Layer 1-3)

214 Parts of titanium oxide ($TiO_2$) particles coated with oxygen-deficient tin oxide ($SnO_2$) serving as metal oxide particles, 132 parts of a phenol resin (monomer/oligomer of a phenol resin) (product name: PLYOPHEN J-325, manufactured by DIC Corporation, resin solid content: 60 mass %) serving as a binding material, and 98 parts of 1-methoxy-2-propanol serving as a solvent were loaded into a sand mill using 450 parts of glass beads each having a diameter of 0.8 mm, and the mixture was subjected to dispersion treatment under the conditions of a rotation number of 2,000 rpm, a dispersion treatment time of 4.5 hours, and a setting temperature of cooling water of 18° C. to obtain a dispersion liquid. The glass beads were removed from the dispersion liquid with a mesh (opening: 150 μm). Silicone resin particles (product name: TOSPEARL 120, manufactured by Momentive Performance Materials Japan LLC, average particle diameter: 2 μm) serving as a surface roughness-imparting material were added to the dispersion liquid so that the amount of the silicone resin particles was 10 mass % with respect to the total mass of the metal oxide particles and the binding material in the dispersion liquid having the glass beads removed therefrom. In addition, a silicone oil (product name: SH28PA, manufactured by Dow Corning Toray Co., Ltd.) serving as a leveling agent was added to the dispersion liquid so that the amount of the silicone oil was 0.01 mass % with respect to the total mass of the metal oxide particles and the binding material in the dispersion liquid, followed by stirring, to thereby prepare a coating liquid 3 for a first conductive layer. The coating liquid 3 for a first conductive layer was applied onto the first support by dip coating to form a coat, and the obtained coat was dried and thermally cured at a temperature of 150° C. for 30 minutes to form a conductive layer 1-3 having a thickness of 30 μm.

(Conductive Layer 1-4)

Anatase-type titanium dioxide serving as a core may be produced by a known sulfuric acid method. Specifically, anatase-type titanium dioxide is obtained by heating and hydrolyzing a solution containing titanium sulfate and titanyl sulfate to produce a metatitanic acid slurry, and dehydrating and firing the metatitanic acid slurry.

Anatase-type titanium oxide particles having an average primary particle diameter of 200 nm were used as core particles. A titanium-niobium sulfuric acid solution containing 33.7 parts of titanium in terms of $TiO_2$ and 2.9 parts of niobium in terms of $Nb_2O_5$ was prepared. 100 Parts of the core particles were dispersed in pure water to obtain 1,000 parts of a suspension, and the suspension was warmed to a temperature of 60° C. The titanium-niobium sulfuric acid solution and 10 mol/L sodium hydroxide were dropped to the suspension over 3 hours so that the pH of the suspension became from 2 to 3. After the total amount had been dropped, the pH was adjusted to a value near a neutral region, and a flocculant was added to the suspension to sediment a solid content. The supernatant was removed, and the residue was filtered and washed, followed by drying at a temperature of 110° C. Thus, an intermediate containing 0.1 wt % of organic matter derived from the flocculant in terms of C was obtained. The intermediate was calcined in nitrogen at a temperature of 750° C. for 1 hour, and was then calcined in air at a temperature of 450° C. to produce titanium oxide particles 1. The obtained particles had an average particle diameter (average primary particle diameter) of 220 nm in the particle diameter measurement method using a scanning electron microscope described above.

Next, 80 parts of a phenol resin (monomer/oligomer of a phenol resin) (product name: PLYOPHEN J-325, manufactured by DIC Corporation, resin solid content: 60%, density after curing: 1.3 g/cm$^3$) serving as a binding material was dissolved in 60 parts of 1-methoxy-2-propanol serving as a solvent. Thus, a solution was obtained.

100 Parts of the metal oxide particles 1 were added to the solution, and the mixture was loaded into a vertical sand mill using 200 parts of glass beads having an average particle diameter of 1.0 mm as a dispersing medium, and was subjected to dispersion treatment under the conditions of a dispersion liquid temperature of 23±3° C. and a rotation number of 1,500 rpm (peripheral speed: 5.5 m/s) for 2 hours to provide a dispersion liquid. The glass beads were removed from the dispersion liquid with a mesh. The dispersion liquid having the glass beads removed therefrom was filtered under pressure through use of a PTFE paper filter (product name: PF060, manufactured by Advantec Toyo Kaisha, Ltd.). To the dispersion liquid after the filtration under pressure, 0.015 part of a silicone oil (product name: SH28 PAINT ADDITIVE, manufactured by Dow Corning Toray Co., Ltd.) serving as a leveling agent and 15 parts of silicone resin particles (product name: KMP-590, manufactured by Shin-Etsu Chemical Co., Ltd., average particle diameter: 2 μm, density: 1.3 g/cm$^3$) serving as a surface roughness-imparting material were added, followed by stirring, to thereby prepare a coating liquid 4 for a first conductive layer. The coating liquid 4 for a first conductive layer was applied onto the above-mentioned first support by dip coating to form a coat, and the obtained coat was cured by heating at a temperature of 145° C. for 1 hour to form a conductive layer 1-4 having a thickness of 25 μm.

<Production of Undercoat Layer>

(Undercoat Layer 1)

25 Parts of N-methoxymethylated nylon 6 (product name: TORESIN EF-30T, manufactured by Nagase ChemteX Corporation) was dissolved in 480 parts of a mixed solution of methanol/n-butanol=2/1 (dissolved by heating at a temperature of 65° C.) to obtain a solution. After that, the solution was filtered with a membrane filter (product name: FP-022, manufactured by Sumitomo Electric Industries, Ltd., pore diameter: 0.22 μm) to prepare a coating liquid 1 for an undercoat layer. The coating liquid 1 for an undercoat layer was applied onto the first support or the first conductive layer by dip coating to form a coat, and the obtained coat was dried, to thereby form an undercoat layer 1 having a thickness of 0.8

(Undercoat Layer 2)

100 Parts of rutile-type titanium oxide particles (manufactured by Tayca Corporation, average primary particle diameter: 50 nm) were mixed with 500 parts of toluene under stirring, and 3.0 parts of ethyltrimethoxysilane in which n=1 and $R^1$ represents a methyl group was added as a compound represented by the following formula (A3) to the mixture, followed by stirring for 8 hours. After that, toluene was evaporated by distillation under reduced pressure, and the residue was dried at a temperature of 120° C. for 3 hours to obtain rutile-type titanium oxide particles that were surface-treated with ethyltrimethoxysilane.

$$CH_3-(CH_2)_n-Si-(O-R^1)_3 \quad \text{(A3)}$$

18 Parts of the above-mentioned rutile-type titanium oxide particles that were surface-treated with ethyltrimethoxysilane, 4.5 parts of N-methoxymethylated nylon (product name: TORESIN EF-30T, manufactured by Nagase ChemteX Corporation), and 1.5 parts of a copolymer nylon resin (product name: Amilan CM8000, manufactured by Toray Industries, Inc.) were added to a mixed solvent of 90 parts of methanol, 60 parts of 1-butanol, and 15 parts of dimethyl ketone acetone to prepare a dispersion liquid. The dispersion liquid was subjected to dispersion treatment for 5 hours with a vertical sand mill through use of glass beads each having a diameter of 1.0 mm, to thereby prepare a coating liquid 2 for an undercoat layer. The coating liquid 2 for an undercoat layer was applied onto the first support or the first conductive layer by dip coating to form a coat, and the obtained coat was dried to form an undercoat layer 2 having a thickness of 0.8 μm.

<Charge-Generating Layer>

10 Parts of a titanyl phthalocyanine crystal (charge-generating substance) of a crystal form having a strong peak at a Bragg angle)(20±0.3° of 27.2° in CuKα characteristic X-ray diffraction, 5 parts of polyvinyl butyral (product name: S-LEC BX-1, manufactured by Sekisui Chemical Co., Ltd.), and 250 parts of cyclohexanone were loaded into a sand mill using glass beads each having a diameter of 0.8 mm, and the mixture was subjected to dispersion treatment under the condition of a dispersion treatment time of 3 hours. Next, 250 parts of ethyl acetate was added to the resultant to prepare a coating liquid for a charge-generating layer. The coating liquid for a charge-generating layer was applied onto the first support, the first conductive layer, or the undercoat layer by dip coating to form a coat, and the obtained coat was dried at a temperature of 100° C. for 10 minutes to form a charge-generating layer having a Macbeth density value of 0.95.

<Charge-Transporting Layer>

90 Parts of a charge-transporting substance represented by the following formula (A4), 100 parts of a polyarylate resin having a repeating unit of the following formula (A5) serving as a binder resin, and 0.05 part of a silicone oil (product name: KF-96, manufactured by Shin-Etsu Silicone K.K.) serving as a leveling agent were mixed with a mixed solvent of 480 parts of tetrahydrofuran and 120 parts of toluene to prepare a coating liquid for a charge-transporting layer. The coating liquid for a charge-transporting layer was applied onto the charge-generating layer by dip coating to form a coat, and the obtained coat was dried at a temperature of 140° C. for 30 minutes to form a charge-transporting layer having a thickness of 20 μm.

(A4)

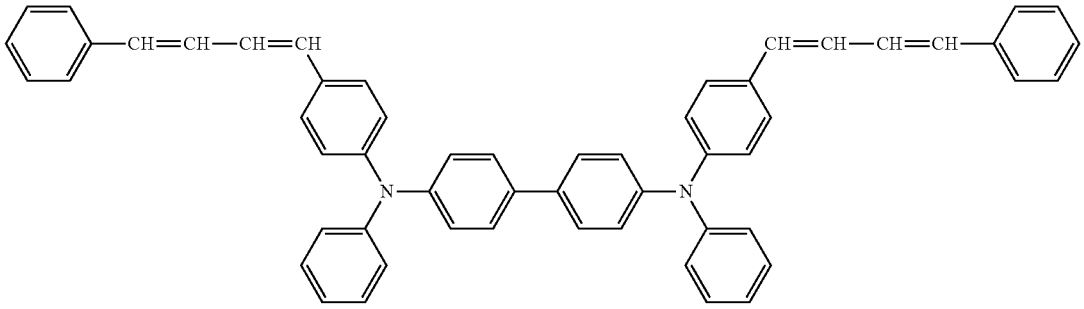

(A5)

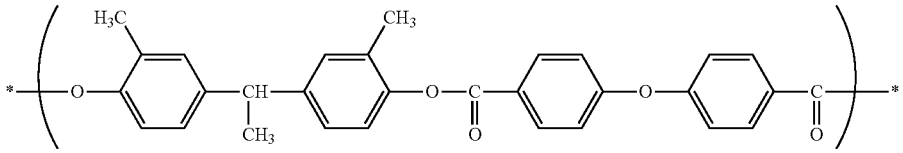

TABLE 1

| Photosensitive member | Surface treatment layer | Conductive layer | Undercoat layer |
|---|---|---|---|
| 1 | 1 | — | — |
| 2 | 2 | — | — |
| 3 | 1 | — | 2 |
| 4 | 2 | — | 2 |
| 5 | — | 1-1 | 1 |
| 6 | — | 1-1 | 2 |
| 7 | — | 1-2 | — |
| 8 | 3 | — | 2 |
| 9 | 4 | — | — |
| 10 | 5 | — | 2 |
| 11 | — | 1-3 | 1 |
| 12 | — | 1-3 | 2 |
| 13 | — | 1-4 | 2 |

(Production of Unvulcanized Rubber Mixture for Forming Domains (CMB))

Production Example of CMB 1

100 Parts of a butyl rubber (product name: JSR Butyl 065, manufactured by JSR Corporation) serving as a raw material rubber, 60 parts of carbon black (product name: TOKABLACK #5500, manufactured by Tokai Carbon Co., Ltd.) serving as an electron conductive agent, 5 parts of zinc oxide (product name: Zinc Oxide Type 2, manufactured by Sakai Chemical Industry Co., Ltd.) serving as a vulcanization accelerator, and 2 parts of zinc stearate (product name: SZ-2000, manufactured by Sakai Chemical Industry Co., Ltd.) serving as a processing aid were mixed with each other through use of a 6-liter pressure kneader (product name: TD6-15MDX, manufactured by Toshin Co., Ltd.) to produce CMB 1. Mixing conditions were set to a filling ratio of 70 vol %, a blade rotation number of 30 rpm, and a mixing time of 20 minutes.

In this case, an SP value and a Mooney viscosity of the raw material rubber, and a Mooney viscosity of the CMB 1 were measured by the above-mentioned method. The results thereof are shown in Table 2 together with each material configuration of the CMB 1.

Material abbreviated names of the raw material rubber species in Table 2 are shown in Table 4, and material abbreviated names of the electron conductive agent in Table 2 are shown in Table 5.

The term "parts by mass" in Table 2 means parts by mass of the electron conductive agent with respect to 100 parts of the raw material rubber species.

Production Examples of CMB 2 to CMB 8

CMB 2 to CMB 8 were produced in the same manner as in the production example of the CMB 1 except that the raw material rubber species and the electron conductive agent were changed as shown in Table 2 in the production example of the CMB 1.

In addition, an SP value and a Mooney viscosity of each of the raw material rubbers of the CMB 2 to the CMB 8, and a Mooney viscosity of each of the CMB 2 to the CMB 8 were measured in the same manner as in the CMB 1. The results thereof are shown in Table 2 together with each material configuration of the CMB 2 to the CMB 8. Material abbreviated names of the raw material rubber species in Table 2 are shown in Table 4, and material abbreviated names of the electron conductive agent in Table 2 are shown in Table 5.

TABLE 2

| | Raw material rubber species | | | | Electron conductive agent | | | Dispersion | |
|---|---|---|---|---|---|---|---|---|---|
| CMB | Material abbreviated name | | SP value/ $MPa^{0.5}$ | Mooney viscosity | Material abbreviated name | Parts by mass | DBP/ $cm^3/100$ g | time/ min | Mooney viscosity |
| 1 | Butyl | JSR065 | 15.8 | 32 | #5500 | 60 | 155 | 20 | 85 |
| 2 | NBR | N230SV | 19.2 | 32 | #7360 | 60 | 87 | 20 | 75 |
| 3 | SBR | T1000 | 16.8 | 45 | #5500 | 55 | 155 | 20 | 83 |
| 4 | SBR | T1000 | 16.8 | 45 | #5500 | 60 | 155 | 20 | 92 |
| 5 | NBR | N230SV | 19.2 | 32 | #7360 | 55 | 87 | 20 | 68 |
| 6 | SBR | T1000 | 16.8 | 45 | #5500 | 53 | 155 | 20 | 81 |
| 7 | SBR | T2003 | 17 | 45 | #5500 | 60 | 155 | 20 | 92 |
| 8 | NBR | N230SV | 19.2 | 32 | #7360 | 40 | 87 | 20 | 57 |

Regarding the Mooney viscosity in Table 2, values of the Mooney viscosity of the raw material rubbers are catalog values of respective manufacturers. A value of the Mooney viscosity of each CMB is a Mooney viscosity ML (1+4) based on JIS K6300-1:2013, and is obtained by measurement at a rubber temperature when all the materials forming the CMB are kneaded.

(Production of Rubber Mixture for Forming Matrix (MRC))

Production Example of MRC 1

100 Parts of a styrene-butadiene rubber (product name: T1000, manufactured by Asahi Kasei Corporation) serving as a raw material rubber, 70 parts of calcium carbonate (product name: NANOX #30, manufactured by Maruo Calcium Co., Ltd.) serving as a filler, 7 parts of zinc oxide (product name: Zinc Oxide Type 2, manufactured by Sakai Chemical Industry Co., Ltd.) serving as a vulcanization accelerator, and 2.8 parts of zinc stearate (product name: SZ-2000, manufactured by Sakai Chemical Industry Co., Ltd.) serving as a processing aid were mixed with each other through use of a 6-liter pressure kneader (product name: TD6-15MDX, manufactured by Toshin Co., Ltd.) to produce MRC 1. Mixing conditions were set to a filling ratio of 70 vol %, a blade rotation number of 30 rpm, and a mixing time of 16 minutes.

In this case, an SP value and a Mooney viscosity of the raw material rubber, and a Mooney viscosity of the MRC 1 were measured by the above-mentioned method. The results thereof are shown in Table 3 together with each material configuration of the MRC 1.

The term "parts by mass" in Table 3 means parts by mass of the conductive agent with respect to 100 parts of the raw material rubber species. Material abbreviated names of the raw material rubber species in Table 3 are shown in Table 4.

Production Examples of MRC 2 to MRC 7

MRC 2 to MRC 7 were produced in the same manner as in the production example of the MRC 1 except that the raw material rubber species was changed as shown in Table 3 in the production example of the MRC 1.

In addition, an SP value and a Mooney viscosity of each of the raw material rubbers of the MRC 2 to the MRC 7, and a Mooney viscosity of each of the MRC 2 to the MRC 7 were measured in the same manner as in the production example of the MRC 1. The results thereof are shown in Table 3 together with each material configuration of the MRC 2 to the MRC 7.

TABLE 3

| | Raw material rubber species | | | | Dispersion | |
|---|---|---|---|---|---|---|
| MRC | Material abbreviated name | | SP value/ $MPa^{0.5}$ | Mooney viscosity | time/ min | Mooney viscosity |
| 1 | SBR | T1000 | 16.8 | 45 | 16 | 51 |
| 2 | SBR | A303 | 17 | 46 | 16 | 52 |
| 3 | NBR | N230SV | 19.2 | 32 | 16 | 37 |
| 4 | SBR | T2003 | 17 | 45 | 16 | 38 |
| 5 | EPDM | 301A | 16 | 44 | 16 | 51 |
| 6 | Butyl | JSR065 | 15.8 | 32 | 16 | 40 |
| 7 | NBR | N220S | 20.4 | 57 | 16 | 62 |

TABLE 4

| Material abbreviated name | | Material name | Product name | Manufacturer name |
|---|---|---|---|---|
| Butyl | JSR065 | Butyl rubber | JSR Butyl 065 | JSR Corporation |
| EPDM | 301A | Ethylene-propylene-diene rubber | Esprene301A | Sumitomo Chemical Co., Ltd. |
| NBR | N2305V | Acrylonitrile-butadiene rubber | NBR N230SV | JSR Corporation |
| NBR | N2205 | Acrylonitrile-butadiene rubber | NBR N2205 | JSR Corporation |
| SBR | T2003 | Styrene-butadiene rubber | Tufdene 2003 | Asahi Kasei Corporation |
| SBR | T1000 | Styrene-butadiene rubber | Tufdene 1000 | Asahi Kasei Corporation |
| SBR | A303 | Styrene-butadiene rubber | Asaprene 303 | Asahi Kasei Corporation |

TABLE 5

| Material abbreviated name | Material name | Product name | Manufacturer name |
|---|---|---|---|
| #7360 | Conductive carbon black | TOKABLACK #7360SB | Tokai Carbon Co., Ltd. |
| #5500 | Conductive carbon black | TOKABLACK #5500 | Tokai Carbon Co., Ltd. |

<Production of Charging Member>

Production Example of Charging Roller 1

As the columnar second support, a round bar having a total length of 252 mm and an outer diameter of 6 mm obtained by subjecting the surface of stainless steel (SUS 304) to electroless nickel plating was prepared.

Next, CMB 1 and MRC 1 were mixed with each other through use of a 6-liter pressure kneader (product name: TD6-15MDX, manufactured by Toshin Co., Ltd.) in blending amounts of 25 parts of the CMB 1 and 75 parts of the MRC 1. Mixing conditions were set to a filling ratio of 70 vol %, a blade rotation number of 30 rpm, and a mixing time of 16 minutes.

Next, 100 parts of the mixture of the CMB 1 and the MRC 1, 3 parts of sulfur (product name: SULFAX PMC, manufactured by Tsurumi Chemical Industry Co., Ltd.) serving as a vulcanizing agent, and 3 parts of tetramethylthiuram disulfide (product name: NOCCELER TT-P, manufactured by Ouchi Shinko Chemical Industrial Co., Ltd.) serving as a vulcanization aid were mixed with each other through use of an open roll having a roll diameter of 12 inches, to thereby prepare an unvulcanized rubber mixture for forming a second conductive layer. The left and right turn-over was performed 20 times in total under the mixing conditions of a front roll rotation number of 10 rpm, a back roll rotation number of 8 rpm, and a roll gap of 2 mm. After that, the roll gap was set to 0.5 mm, and thinning was performed 10 times.

Figure 13:
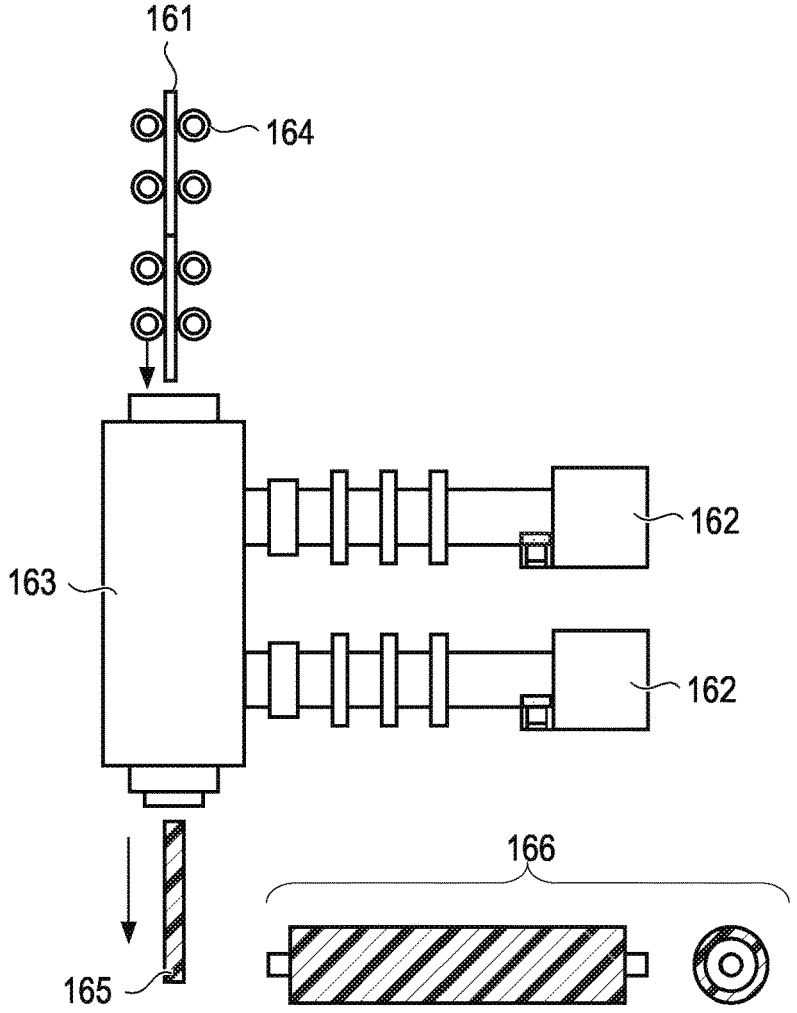
FIG. 13 is an explanatory view of a method of producing a charging member.

Subsequently, an unvulcanized rubber roller was produced through use of a device illustrated in FIG. 13. A die having an inner diameter of 10 mm was mounted on a distal end of each of extruders 162 of a crosshead 163 including a supply mechanism 164 for a second support 161 and a discharge mechanism for an unvulcanized rubber roller. The temperature of each of the extruders 162 and the crosshead 163 was set to 80° C., and the conveyance speed of the second support 161 was adjusted to 60 mm/sec. Under the conditions, the unvulcanized rubber mixture for forming a second conductive layer was supplied from each of the extruders 162, and an outer peripheral portion of the second support 161 was coated with the unvulcanized rubber mixture for forming a second conductive layer in the crosshead 163, to thereby obtain an unvulcanized rubber roller 165.

Next, the unvulcanized rubber roller 165 was loaded into a hot-air vulcanizing furnace at a temperature of 160° C. and heated for 60 minutes to vulcanize the unvulcanized rubber mixture for forming a second conductive layer, to thereby form a second conductive layer on the outer peripheral portion of the second support 161. After that, both end portions of the second conductive layer were each removed by 10 mm to set the length in a longitudinal direction of the second conductive layer portion to 232 mm, to thereby obtain a roller 166.

Finally, the surface of the second conductive layer of the roller 166 was polished with a rotary grinding stone. With this, a charging roller 1 having a crown shape in which each of diameters at positions distant from a center portion to both end portion sides by 90 mm was 8.4 mm, and a center portion diameter was 8.5 mm was produced.

The volume resistivity $\rho_D$ (Ω·cm) of domains of the charging roller 1 obtained in this case, and the volume resistivity $\rho_M$ (Ω·cm) of a matrix thereof were measured by the above-mentioned method. The results thereof are shown in Table 6 together with the configuration of the charging roller 1.

Material abbreviated names of the vulcanizing agent and the vulcanization accelerator in Table 6 are shown in Table 7.

Production Examples of Charging Rollers 2 to 15

Charging rollers 2 to 15 were produced in the same manner as in the production example of the charging roller 1 except that the CMB, the MRC, the mixing ratio of the CMB and the MRC, and the vulcanization accelerator were changed as shown in Table 6 in the production example of the charging roller 1.

In addition, the volume resistivity $\rho_D$ (Ω·cm) of domains of the charging rollers 2 to 15, and the volume resistivity $\rho_M$ (Ω·cm) of a matrix thereof were measured in the same manner as in the charging roller 1. The results thereof are shown in Table 6 together with the configurations of the charging rollers 2 to 15.

TABLE 6

| Charging roller | Unvulcanized rubber mixture: CMB Production example | MRC Production example | CMB Part(s) by mass | MRC Part(s) by mass | Vulcanizing agent: Material abbreviated name | Part(s) by mass | Vulcanization accelerator: Material abbreviated name | Part(s) by mass | Sea-island structure | ρD [Ω · cm] | ρM [Ω · cm] |
|---|---|---|---|---|---|---|---|---|---|---|---|
| 1 | 1 | 1 | 25 | 75 | Sulfur | 3 | TT | 3 | Present | $1.25 \times 10^{2}$ | $4.69 \times 10^{13}$ |
| 2 | 2 | 2 | 25 | 75 | Sulfur | 3 | TBZTD | 1 | Present | $6.22 \times 10^{2}$ | $2.11 \times 10^{12}$ |
| 3 | 3 | 3 | 25 | 75 | Sulfur | 3 | TBZTD | 1 | Present | $2.25 \times 10^{2}$ | $2.58 \times 10^{9}$ |
| 4 | 4 | 3 | 25 | 75 | Sulfur | 3 | TBZTD | 1 | Present | $7.55 \times 10^{1}$ | $2.65 \times 10^{9}$ |
| 5 | 1 | 4 | 25 | 75 | Sulfur | 3 | TT | 3 | Present | $2.22 \times 10^{2}$ | $5.55 \times 10^{12}$ |
| 6 | 2 | 1 | 25 | 75 | Sulfur | 3 | TBZTD | 1 | Present | $1.22 \times 10^{2}$ | $5.22 \times 10^{13}$ |
| 7 | 2 | 5 | 25 | 75 | Sulfur | 3 | TET | 1 | Present | $6.11 \times 10^{1}$ | $2.21 \times 10^{15}$ |
| 8 | 5 | 6 | 25 | 75 | Sulfur | 3 | TT | 3 | Present | $1.11 \times 10^{3}$ | $5.22 \times 10^{16}$ |
| 9 | 6 | 3 | 25 | 75 | Sulfur | 3 | TBZTD | 1 | Present | $3.22 \times 10^{3}$ | $2.77 \times 10^{9}$ |
| 10 | 1 | 2 | 25 | 75 | Sulfur | 3 | TT | 3 | Present | $3.22 \times 10^{2}$ | $3.20 \times 10^{12}$ |
| 11 | 7 | 7 | 25 | 75 | Sulfur | 3 | TBZTD | 1 | Present | $5.10 \times 10^{1}$ | $9.55 \times 10^{9}$ |
| 12 | 2 | 4 | 25 | 75 | Sulfur | 3 | TBZTD | 1 | Present | $1.11 \times 10^{2}$ | $7.66 \times 10^{12}$ |
| 13 | 5 | 5 | 25 | 75 | Sulfur | 3 | TET | 1 | Present | $1.25 \times 10^{3}$ | $3.22 \times 10^{15}$ |
| 14 | 2 | 6 | 25 | 75 | Sulfur | 3 | TT | 3 | Present | $1.23 \times 10^{2}$ | $7.13 \times 10^{16}$ |
| 15 | 8 | — | 100 | 0 | Sulfur | 3 | TBZTD | 1 | Absent | $2.25 \times 10^{5}$ | — |

TABLE 7

| Material abbreviated name | Material name | Product name | Manufacturer name |
|---|---|---|---|
| Sulfur | Sulfur | SULFAX PMC | Tsurumi Chemical Industry Co., Ltd. |
| TT | Tetramethylthiuram disulfide | NOCCELER TT-P | Ouchi Shinko Chemical Industrial Co., Ltd. |
| TBZTD | Tetrabenzylthiuram disulfide | SANCELER TBZTD | Sanshin Chemical Industry Co., Ltd. |
| TET | Tetraethylthiuram disulfide | SANCELER TET-G | Sanshin Chemical Industry Co., Ltd. |

Example 1

A photosensitive member 1 and a charging member 1 were mounted on a process cartridge of a laser beam printer (product name: Color Laser Jet Enterprise M653dn) manufactured by Hewlett-Packard Company to prepare a process cartridge of Example 1.

In this case, measurement values of $f_{OPC}$ and $z_{OPC}$ of the photosensitive member 1 used herein, measurement values of $f_C$ and $z_C$ of the charging member 1, and a calculated value of $\rho_M/\rho_D$, and calculated values of $f_{OPC}/f_C$ and $(z_{OPC} \times z_C)^{0.5}$ when the photosensitive member 1 and the charging member 1 are combined with each other are shown in Table 8.

Examples 2 to 36 and Comparative Examples 1 to 6

Process cartridges of Examples 2 to 36 and Comparative Examples 1 to 6 were prepared in the same manner as in Example 1 except that the photosensitive member 1 and the charging member 1 were changed as shown in Table 8 in Example 1.

In addition, measurement values of $f_{OPC}$ and $z_{OPC}$ of the photosensitive members used herein, measurement values of $f_C$ and $z_C$ of the charging members, and each calculated value of $\rho_M/\rho_D$, and calculated values of $f_{OPC}/f_C$ and $(z_{OPC} \times z_C)^{0.5}$ when each of the photosensitive members and each of the charging members are combined with each other are shown in Table 8.

TABLE 8

| Example | Production example of photsensitive member | $f_{OPC}$/ Hz | $z_{OPC}$/ Ω · cm² | Production example of charging unit | $f_C$/ Hz | $z_C$/ Ω · cm² | $\rho_M/\rho_D$/– | $f_{OPC}/f_C$/– | $(z_{OPC} \times z_C)^{0.5}$/ Ω · cm² |
|---|---|---|---|---|---|---|---|---|---|
| 1 | Photosensitive member 1 | $3.0 \times 10^{-1}$ | $2.0 \times 10^{3}$ | Charging roller 1 | $2.0 \times 10^{3}$ | $1.0 \times 10^{11}$ | $3.8 \times 10^{11}$ | $1.5 \times 10^{-4}$ | $2.6 \times 10^{8}$ |
| 2 | Photosensitive member 2 | $1.2 \times 10^{1}$ | $2.0 \times 10^{3}$ | Charging roller 1 | $2.0 \times 10^{3}$ | $5.0 \times 10^{10}$ | $3.8 \times 10^{11}$ | $6.0 \times 10^{-3}$ | $1.8 \times 10^{8}$ |
| 3 | Photosensitive member 3 | $3.0 \times 10^{-1}$ | $2.0 \times 10^{3}$ | Charging roller 1 | $2.0 \times 10^{3}$ | $1.0 \times 10^{11}$ | $3.8 \times 10^{11}$ | $1.5 \times 10^{-4}$ | $2.6 \times 10^{8}$ |
| 4 | Photosensitive member 2 | $1.2 \times 10^{1}$ | $2.0 \times 10^{3}$ | Charging roller 1 | $2.0 \times 10^{3}$ | $5.0 \times 10^{10}$ | $3.8 \times 10^{11}$ | $6.0 \times 10^{-3}$ | $1.8 \times 10^{8}$ |
| 5 | Photosensitive member 5 | $2.8 \times 10^{4}$ | $2.0 \times 10^{3}$ | Charging roller 1 | $2.0 \times 10^{3}$ | $1.3 \times 10^{2}$ | $3.8 \times 10^{11}$ | $1.4 \times 10^{1}$ | $9.4 \times 10^{3}$ |
| 6 | Photosensitive member 6 | $2.8 \times 10^{4}$ | $2.0 \times 10^{3}$ | Charging roller 1 | $2.0 \times 10^{3}$ | $1.3 \times 10^{2}$ | $3.8 \times 10^{11}$ | $1.4 \times 10^{1}$ | $9.4 \times 10^{3}$ |
| 7 | Photosensitive member 7 | $9.5 \times 10^{0}$ | $2.0 \times 10^{3}$ | Charging roller 1 | $2.0 \times 10^{3}$ | $6.2 \times 10^{5}$ | $3.8 \times 10^{11}$ | $4.8 \times 10^{-3}$ | $6.4 \times 10^{5}$ |
| 8 | Photosensitive member 1 | $3.0 \times 10^{-1}$ | $2.0 \times 10^{1}$ | Charging roller 2 | $2.0 \times 10^{1}$ | $1.0 \times 10^{11}$ | $3.4 \times 10^{9}$ | $1.5 \times 10^{-2}$ | $1.7 \times 10^{9}$ |
| 9 | Photosensitive member 8 | $2.0 \times 10^{2}$ | $2.0 \times 10^{1}$ | Charging roller 2 | $2.0 \times 10^{1}$ | $6.0 \times 10^{9}$ | $3.4 \times 10^{9}$ | $1.0 \times 10^{1}$ | $4.2 \times 10^{8}$ |

TABLE 8-continued

| | | | | | | | | | |
|---|---|---|---|---|---|---|---|---|---|
| 10 | Photosensitive member 9 | $6.0 \times 10^{3}$ | $2.0 \times 10^{1}$ | Charging roller 2 | $2.0 \times 10^{1}$ | $1.2 \times 10^{9}$ | $3.4 \times 10^{9}$ | $3.0 \times 10^{2}$ | $1.9 \times 10^{8}$ |
| 11 | Photosensitive member 10 | $2.0 \times 10^{5}$ | $2.0 \times 10^{1}$ | Charging roller 2 | $2.0 \times 10^{1}$ | $2.4 \times 10^{8}$ | $3.4 \times 10^{9}$ | $1.0 \times 10^{4}$ | $8.3 \times 10^{7}$ |
| 12 | Photosensitive member 5 | $2.8 \times 10^{4}$ | $2.0 \times 10^{1}$ | Charging roller 2 | $2.0 \times 10^{1}$ | $1.3 \times 10^{2}$ | $3.4 \times 10^{9}$ | $1.4 \times 10^{3}$ | $6.2 \times 10^{4}$ |
| 13 | Photosensitive member 11 | $8.9 \times 10^{2}$ | $2.0 \times 10^{1}$ | Charging roller 2 | $2.0 \times 10^{1}$ | $6.0 \times 10^{3}$ | $3.4 \times 10^{9}$ | $4.5 \times 10^{1}$ | $4.1 \times 10^{5}$ |
| 14 | Photosensitive member 6 | $2.8 \times 10^{4}$ | $2.0 \times 10^{1}$ | Charging roller 2 | $2.0 \times 10^{1}$ | $1.3 \times 10^{2}$ | $3.4 \times 10^{9}$ | $1.4 \times 10^{3}$ | $6.2 \times 10^{4}$ |
| 15 | Photosensitive member 12 | $8.9 \times 10^{2}$ | $2.0 \times 10^{1}$ | Charging roller 2 | $2.0 \times 10^{1}$ | $6.0 \times 10^{3}$ | $3.4 \times 10^{9}$ | $4.5 \times 10^{1}$ | $4.1 \times 10^{5}$ |
| 16 | Photosensitive member 13 | $4.6 \times 10^{3}$ | $2.0 \times 10^{1}$ | Charging roller 2 | $2.0 \times 10^{1}$ | $1.5 \times 10^{4}$ | $3.4 \times 10^{9}$ | $2.3 \times 10^{2}$ | $6.6 \times 10^{5}$ |
| 17 | Photosensitive member 11 | $8.9 \times 10^{2}$ | $1.3 \times 10^{0}$ | Charging roller 3 | $1.3 \times 10^{0}$ | $6.0 \times 10^{3}$ | $1.1 \times 10^{7}$ | $6.8 \times 10^{2}$ | $1.4 \times 10^{6}$ |
| 18 | Photosensitive member 13 | $4.6 \times 10^{3}$ | $1.3 \times 10^{0}$ | Charging roller 3 | $1.3 \times 10^{0}$ | $1.5 \times 10^{4}$ | $1.1 \times 10^{7}$ | $3.6 \times 10^{3}$ | $2.3 \times 10^{6}$ |
| 19 | Photosensitive member 1 | $3.0 \times 10^{-1}$ | $3.0 \times 10^{0}$ | Charging roller 4 | $3.0 \times 10^{0}$ | $1.0 \times 10^{11}$ | $3.4 \times 10^{7}$ | $1.0 \times 10^{-1}$ | $3.9 \times 10^{9}$ |
| 20 | Photosensitive member 1 | $3.0 \times 10^{-1}$ | $1.2 \times 10^{2}$ | Charging roller 5 | $1.2 \times 10^{2}$ | $1.0 \times 10^{11}$ | $2.5 \times 10^{10}$ | $2.5 \times 10^{-3}$ | $7.1 \times 10^{8}$ |
| 21 | Photosensitive member 1 | $3.0 \times 10^{-1}$ | $2.7 \times 10^{3}$ | Charging roller 6 | $2.7 \times 10^{3}$ | $1.0 \times 10^{11}$ | $9.8 \times 10^{11}$ | $1.1 \times 10^{-4}$ | $1.2 \times 10^{8}$ |
| 22 | Photosensitive member 2 | $1.2 \times 10^{1}$ | $1.2 \times 10^{2}$ | Charging roller 5 | $1.2 \times 10^{2}$ | $5.0 \times 10^{10}$ | $2.5 \times 10^{10}$ | $1.0 \times 10^{-1}$ | $5.0 \times 10^{8}$ |
| 23 | Photosensitive member 2 | $1.2 \times 10^{1}$ | $2.7 \times 10^{3}$ | Charging roller 6 | $2.7 \times 10^{3}$ | $5.0 \times 10^{10}$ | $9.8 \times 10^{11}$ | $4.4 \times 10^{-3}$ | $8.7 \times 10^{7}$ |
| 24 | Photosensitive member 2 | $1.2 \times 10^{1}$ | $1.2 \times 10^{5}$ | Charging roller 7 | $1.2 \times 10^{5}$ | $5.0 \times 10^{10}$ | $3.6 \times 10^{13}$ | $1.0 \times 10^{-4}$ | $1.4 \times 10^{7}$ |
| 25 | Photosensitive member 6 | $2.8 \times 10^{4}$ | $3.0 \times 10^{0}$ | Charging roller 4 | $3.0 \times 10^{0}$ | $1.3 \times 10^{2}$ | $3.4 \times 10^{7}$ | $9.2 \times 10^{3}$ | $1.4 \times 10^{5}$ |
| 26 | Photosensitive member 6 | $2.8 \times 10^{4}$ | $1.2 \times 10^{2}$ | Charging roller 5 | $1.2 \times 10^{2}$ | $1.3 \times 10^{2}$ | $2.5 \times 10^{10}$ | $2.3 \times 10^{2}$ | $2.6 \times 10^{4}$ |
| 27 | Photosensitive member 6 | $2.8 \times 10^{4}$ | $2.7 \times 10^{3}$ | Charging roller 6 | $2.7 \times 10^{3}$ | $1.3 \times 10^{2}$ | $9.8 \times 10^{11}$ | $1.0 \times 10^{1}$ | $4.5 \times 10^{3}$ |
| 28 | Photosensitive member 6 | $2.8 \times 10^{4}$ | $2.8 \times 10^{5}$ | Charging roller 8 | $2.8 \times 10^{5}$ | $1.3 \times 10^{2}$ | $4.7 \times 10^{13}$ | $9.8 \times 10^{-2}$ | $5.2 \times 10^{2}$ |
| 29 | Photosensitive member 11 | $8.9 \times 10^{2}$ | $1.0 \times 10^{-1}$ | Charging roller 9 | $1.0 \times 10^{1}$ | $6.0 \times 10^{3}$ | $8.0 \times 10^{5}$ | $8.9 \times 10^{3}$ | $5.2 \times 10^{6}$ |
| 30 | Photosensitive member 11 | $8.9 \times 10^{2}$ | $3.0 \times 10^{0}$ | Charging roller 4 | $3.0 \times 10^{0}$ | $6.0 \times 10^{3}$ | $3.4 \times 10^{7}$ | $3.0 \times 10^{2}$ | $9.5 \times 10^{5}$ |
| 31 | Photosensitive member 11 | $8.9 \times 10^{2}$ | $8.0 \times 10^{1}$ | Charging roller 10 | $8.0 \times 10^{1}$ | $6.0 \times 10^{3}$ | $9.9 \times 10^{9}$ | $1.1 \times 10^{1}$ | $2.1 \times 10^{5}$ |
| 32 | Photosensitive member 11 | $8.9 \times 10^{2}$ | $1.5 \times 10^{1}$ | Charging roller 11 | $1.5 \times 10^{1}$ | $6.0 \times 10^{3}$ | $2.0 \times 10^{8}$ | $5.9 \times 10^{1}$ | $4.9 \times 10^{5}$ |
| 33 | Photosensitive member 11 | $8.9 \times 10^{2}$ | $2.8 \times 10^{5}$ | Charging roller 8 | $2.8 \times 10^{5}$ | $6.0 \times 10^{3}$ | $4.7 \times 10^{13}$ | $3.2 \times 10^{-3}$ | $3.5 \times 10^{3}$ |
| 34 | Photosensitive member 13 | $4.6 \times 10^{3}$ | $4.5 \times 10^{2}$ | Charging roller 12 | $4.5 \times 10^{2}$ | $1.5 \times 10^{4}$ | $1.3 \times 10^{11}$ | $1.0 \times 10^{1}$ | $1.6 \times 10^{5}$ |
| 35 | Photosensitive member 13 | $4.6 \times 10^{3}$ | $5.0 \times 10^{4}$ | Charging roller 13 | $5.0 \times 10^{4}$ | $1.5 \times 10^{4}$ | $2.6 \times 10^{12}$ | $9.3 \times 10^{-2}$ | $1.8 \times 10^{4}$ |
| 36 | Photosensitive member 13 | $4.6 \times 10^{3}$ | $5.0 \times 10^{5}$ | Charging roller 14 | $5.0 \times 10^{5}$ | $1.5 \times 10^{4}$ | $1.4 \times 10^{15}$ | $9.3 \times 10^{-3}$ | $4.3 \times 10^{3}$ |

| Comparative Example | Production example of photsensitive member | $f_{OPC}$/ Hz | $z_{OPC}$/ $\Omega \cdot cm^2$ | Production example of charging unit | $f_C$/ Hz | $z_C$/ $\Omega \cdot cm^2$ | $\rho_M/\rho_D$/– | $f_{OPC}/f_C$/– | $(z_{OPC} \times z_C)^{0.5}$/ $\Omega \cdot cm^2$ |
|---|---|---|---|---|---|---|---|---|---|
| 1 | Photosensitive member 6 | $2.8 \times 10^{4}$ | $1.3 \times 10^{2}$ | Charging roller 3 | $1.3 \times 10^{0}$ | $3.5 \times 10^{8}$ | $1.1 \times 10^{7}$ | $2.1 \times 10^{4}$ | $2.2 \times 10^{5}$ |
| 2 | Photosensitive member 1 | $3.0 \times 10^{-1}$ | $1.0 \times 10^{11}$ | Charging roller 3 | $1.3 \times 10^{0}$ | $3.5 \times 10^{8}$ | $1.1 \times 10^{7}$ | $2.3 \times 10^{-1}$ | $5.9 \times 10^{9}$ |
| 3 | Photosensitive member 7 | $9.5 \times 10^{0}$ | $6.2 \times 10^{5}$ | Charging roller 2 | $2.0 \times 10^{1}$ | $2.9 \times 10^{7}$ | $3.4 \times 10^{9}$ | $4.8 \times 10^{-1}$ | $4.2 \times 10^{6}$ |
| 4 | Photosensitive member 11 | $8.9 \times 10^{2}$ | $6.0 \times 10^{3}$ | Charging roller 1 | $2.0 \times 10^{3}$ | $6.7 \times 10^{5}$ | $3.8 \times 10^{11}$ | $4.5 \times 10^{-1}$ | $6.3 \times 10^{4}$ |
| 5 | Photosensitive member 7 | $9.5 \times 10^{0}$ | $6.2 \times 10^{5}$ | Charging roller 15 | $2.5 \times 10^{0}$ | $3.5 \times 10^{8}$ | $0.0 \times 10^{0}$ | $3.8 \times 10^{0}$ | $1.5 \times 10^{7}$ |
| 6 | Photosensitive member 7 | $9.5 \times 10^{0}$ | $6.2 \times 10^{5}$ | Charging roller 3 | $1.3 \times 10^{0}$ | $3.5 \times 10^{8}$ | $1.1 \times 10^{7}$ | $7.3 \times 10^{0}$ | $1.5 \times 10^{7}$ |

(Evaluation)

Each of process cartridges of Examples and Comparative Examples was evaluated as described below.

<Evaluation Device>

A laser beam printer (product name: Color Laser Jet Enterprise M653dn) manufactured by Hewlett-Packard Company was prepared as an electrophotographic apparatus to be evaluated. The laser beam printer was reconstructed so that a motor was configured to drive and rotate a photosensitive drum and the like at 80 rpm, and further, the application voltage to a charging roller, and the pre-exposure amount and image exposure amount to a photosensitive member were able to be regulated and measured.

In addition, three process cartridges of each of Examples and each of Comparative Examples were prepared. Each of the process cartridges was mounted to only a process cartridge station for a magenta color, and hence the laser beam printer was reconstructed so as to operate even when process cartridges for other colors (cyan, yellow, and black) were not mounted to a main body of the laser beam printer.

At the time of image output, only the process cartridge for a magenta color was mounted to the main body of the laser beam printer, and a monochromatic image was output only with magenta toner.

<Lateral Running>

First, two photosensitive members were removed from each of the process cartridges. A drill that was being rotated was perpendicularly inserted into a center portion of the surface of each of the photosensitive members, and a hole having a diameter of 2 mm was formed until an undercoat layer was exposed. In this case, five holes were formed in each of the photosensitive members while being displaced in a circumferential direction of the photosensitive member so that a plurality of holes were not present on the same axis in a longitudinal direction of the photosensitive member. A lateral running test was performed as described below through use of the photosensitive member and the charging member 1.

Figure 14:
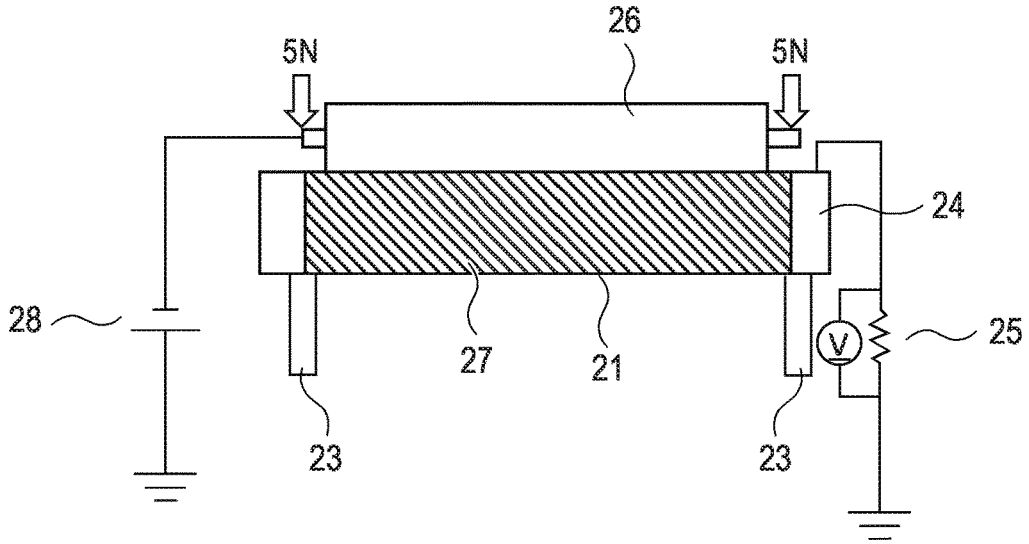
FIG. 14 is a schematic view of a leakage test device.

A leakage test device is illustrated in FIG. 14. The lateral running test is performed under an environment of a high-temperature and high-humidity (temperature of 30° C./relative humidity of 80%). Both ends of an electrophotographic photosensitive member 21 are placed and fixed on a fixing stage 23 so as not to move. A contact portion 24 with respect to a first support of the electrophotographic photosensitive member 21 is connected to ground through intermediation of a reference resistor 25 of 100 kΩ. Next, a charging member 26 is brought into abutment against a center portion of a photosensitive layer 27 of the electrophotographic photosensitive member 21 with one end of 5 N so that the charging member 26 is brought into contact with the center portion. A power source 28 configured to apply a voltage is connected to the charging member 26. The electrophotographic photosensitive member 21 can be rotated about an axis in the longitudinal direction by the contact portion 24 with respect to the first support.

A voltage of −1,500 V was applied to the charging member 26 while the electrophotographic photosensitive member 21 was rotated at a rotation speed of 200 rpm. In this case, in a profile of an electric current flowing from the electrophotographic photosensitive member 21 to ground, an electric current that plunged into a portion in which the undercoat layer was exposed (portion in which an electric current was detected to be larger than those of the other portions) was defined as a lateral running current. Measurement results of the lateral running current in this case are shown in Table 9.

Next, the process cartridge which used the photosensitive member having holes formed therein was prepared again for each of Examples and Comparative Examples, and the process cartridges were placed on an evaluation device one at a time. The application voltage to the charging roller and the image exposure amount to the photosensitive member were set so that a dark potential became −750 V and a light potential became −130 V. In addition, the pre-exposure amount was set to be three times as large as the image exposure amount. For measurement of the surface potential of the photosensitive member at the time of the potential setting, a potential probe (product name: Model 6000B-8, manufactured by Trek Japan KK) mounted at a developing position of the process cartridge was used, and a surface electrometer (product name: Model 344, manufactured by Trek Japan KK) was used.

Through use of the same application voltage to the charging roller and the same pre-exposure amount and image exposure amount to the photosensitive member as those in the foregoing, a halftone image of a one-dot knight-jump pattern was output onto 10,000 sheets.

In the present disclosure, image results corresponding to five portions in which holes were formed in the 10,000th halftone image output were ranked based on the following criteria. The evaluation criteria A to D indicated that the effects of the present disclosure were exhibited. The evaluation results are shown in Table 9.

A: Only black spots are observed in all the five portions.

B: One or two short and thin lateral black streaks are observed in the five portions.

C: Three or more short and thin lateral black streaks are observed in the five portions.

D: One or two long lateral black streaks each extending over the entire region of the image are observed in the five portions.

E: Three or more long lateral black streaks each extending over the entire region of the image are observed in the five portions.

<Potential Fluctuation>

First, the process cartridges of Examples and Comparative Examples were prepared again, and each of the process cartridges and an electrophotographic apparatus were allowed to stand under a low-temperature and low-humidity (L/L: temperature of 15° C./relative humidity of 20%) environment for 24 hours or more. After that, the process cartridge was mounted to a process cartridge station for a magenta color of the electrophotographic apparatus.

The application voltage to a charging roller and the image exposure amount to a photosensitive member were set so that a dark potential became −750 V and a light potential became −130 V. In addition, the pre-exposure amount was set to be three times as large as the image exposure amount. For measurement of the surface potential of the photosensitive member at the time of the potential setting, a potential probe (product name: Model 6000B-8, manufactured by Trek Japan KK) mounted at a developing position of the process cartridge was used, and a surface electrometer (product name: Model 344, manufactured by Trek Japan KK) was used.

The process cartridge and an electrophotographic apparatus were allowed to stand under an environment of a low-temperature and low-humidity (L/L: temperature of 15° C./relative humidity of 20%) for 24 hours or more. After that, the process cartridge was mounted to a process cartridge station for a magenta color of the electrophotographic apparatus. The application voltage to a charging roller and the image exposure amount to a photosensitive member were set so that a dark potential became −750 V and a light potential became −130 V. In addition, the pre-exposure amount was set to be three times as large as the image exposure amount. Through use of the process cartridge and the electrophotographic apparatus, a printing operation was performed in an intermittent mode in which character images with a printing rate of 2% were output one by one onto A4-size plain paper, and a paper passing durability test through image output of 10,000 sheets was performed.

Subsequently, immediately after the paper passing durability test of 10,000 sheets, the application voltage was set again so that a dark potential became −750 V. The application voltage to the charging roller and the image exposure amount to the photosensitive member were set so that a dark potential became −750 V and a light potential became −130 V, and the pre-exposure amount was set to be three times as large as the image exposure amount. Thus, the dark potential and the light potential were measured. The measured light potential was represented by $V_L$ (V), and $\Delta V_L=|V_L+130|$ was determined as a potential fluctuation amount before and after the paper passing durability test of 10,000 sheets.

In the present disclosure, the potential fluctuation was ranked based on the following criteria in accordance with the value of $\Delta V_L$. The evaluation criteria A to D indicated that the effects of the present disclosure were exhibited. The evaluation results are shown in Table 9.

A: $\Delta V_L \leq 15$

B: $15<\Delta V_L \leq 25$

C: $25<\Delta V_L \leq 35$

D: $35<\Delta V_L \leq 45$

E: $45<\Delta V_L$

TABLE 9

| Example | Lateral running current/μA | Lateral running | Potential fluctuation/V | Potential fluctuation rank |
|---|---|---|---|---|
| 1 | 184 | C | 42 | D |
| 2 | 95 | B | 28 | C |
| 3 | 84 | C | 40 | D |
| 4 | 103 | B | 28 | C |
| 5 | 244 | D | 22 | B |
| 6 | 244 | D | 23 | B |
| 7 | 183 | C | 19 | B |
| 8 | 103 | B | 34 | C |
| 9 | 63 | A | 27 | C |
| 10 | 45 | A | 20 | B |
| 11 | 63 | A | 20 | B |
| 12 | 127 | B | 14 | A |
| 13 | 129 | B | 14 | A |
| 14 | 130 | B | 13 | A |
| 15 | 125 | B | 12 | A |
| 16 | 123 | B | 12 | A |
| 17 | 118 | B | 15 | A |
| 18 | 153 | C | 19 | B |
| 19 | 160 | C | 43 | D |
| 20 | 132 | B | 34 | C |
| 21 | 165 | C | 39 | D |
| 22 | 135 | B | 34 | C |
| 23 | 107 | B | 28 | C |
| 24 | 125 | B | 38 | D |
| 25 | 235 | D | 17 | B |
| 26 | 180 | C | 14 | A |
| 27 | 239 | D | 18 | B |
| 28 | 242 | D | 20 | B |
| 29 | 152 | C | 21 | B |
| 30 | 153 | C | 14 | A |
| 31 | 209 | D | 23 | B |
| 32 | 165 | C | 14 | A |
| 33 | 181 | C | 14 | A |
| 34 | 223 | D | 17 | B |
| 35 | 236 | D | 18 | B |
| 36 | 182 | C | 12 | A |

TABLE 9-continued

| Comparative Example | Lateral running current/μA | Lateral running | Potential fluctuation/V | Potential fluctuation rank |
|---|---|---|---|---|
| 1 | 130 | B | 76 | E |
| 2 | 470 | E | 73 | E |
| 3 | 540 | E | 62 | E |
| 4 | 530 | E | 51 | E |
| 5 | 750 | E | 69 | E |
| 6 | 450 | E | 60 | E |

While the present invention has been described with reference to exemplary aspects, it is to be understood that the invention is not limited to the disclosed exemplary aspects. The scope of the following claims is to be accorded the broadest interpretation so as to encompass all such modifications and equivalent structures and functions.

This application claims the benefit of Japanese Patent Application No. 2019-191570, filed Oct. 18, 2019, and Japanese Patent Application No. 2020-155391, filed Sep. 16, 2020, which are hereby incorporated by reference herein in their entirety.

What is claimed is:

1. A process cartridge comprising:

an electrophotographic photosensitive member; and a charging member, the process cartridge being removably mounted onto a main body of an electrophotographic apparatus, wherein the electrophotographic photosensitive member includes a first support having a cylindrical shape, a lowermost layer formed immediately on the first support, and a photosensitive layer formed on the lowermost layer, wherein the charging member is an electrophotographic charging member including a second support having a columnar shape and a second conductive layer formed on the second support, wherein the second conductive layer includes a matrix containing a first rubber and a plurality of domains dispersed in the matrix, wherein the plurality of domains each contain a second rubber and an electron conductive agent, wherein the matrix has a volume resistivity $\rho_M$ that is $1.0\times10^5$ times or more as large as a volume resistivity $\rho_D$ of each of the plurality of domains, and wherein, in a case where a maximum frequency at which a phase of an impedance reaches 45°, when the impedance is measured by applying an AC voltage to the lowermost layer while changing the AC voltage at a frequency within a range of from $1.0\times10^{-2}$ (Hz) to $1.0\times10^6$ (Hz), is represented by $f_{OPC}$ (Hz), and in a case where a maximum frequency at which a phase of an impedance reaches 45°, when the impedance is measured by applying an AC voltage to the charging member while changing the AC voltage at a frequency within a range of from $1.0\times10^{-2}$ (Hz) to $1.0\times10^6$ (Hz), is represented by $f_C$ (Hz), the $f_{OPC}$ and the $f_C$ satisfy a relationship of one of the following expression (D1) and the following expression (D2):

$$10 \leq f_{OPC}/f_C \leq 10{,}000 \quad \text{Expression (D1)}$$

$$0.0001 \leq f_{OPC}/f_C \leq 0.1 \quad \text{Expression (D2).}$$

2. The process cartridge according to claim 1, wherein, in the electrophotographic photosensitive member and the charging member, the $f_{OPC}$ and the $f_C$ satisfy a relationship of one of the following expression (D3) and the following expression (D4):

$$30 \leq f_{OPC}/f_C \leq 3{,}000 \quad \text{Expression (D3)}$$

$$0.0003 \leq f_{OPC}/f_C \leq 0.03 \quad \text{Expression (D4).}$$

3. The process cartridge according to claim 1, wherein, in the electrophotographic photosensitive member, the $f_{OPC}$ is 5 (Hz) or more.

4. The process cartridge according to claim 1, wherein, in the electrophotographic photosensitive member, the $f_{OPC}$ is 100 (Hz) or more.

5. The process cartridge according to claim 1, wherein when, in the electrophotographic photosensitive member, an impedance per unit area of the lowermost layer at a frequency of $f_{OPC}/10$ (Hz) is represented by $z_{OPC}$ ($\Omega \cdot cm^2$), and when, in the charging member, an impedance per unit area of the charging member at a frequency of $f_C/10$ (Hz) is represented by $z_C$ ($\Omega \cdot cm^2$), the $z_{OPC}$ and the $z_C$ satisfy a relationship of the following expression (D5):

$$(z_{OPC} \times z_C) \geq 1.0 \times 10^6 \quad \text{Expression (D5).}$$

6. The process cartridge according to claim 1, wherein, in the electrophotographic photosensitive member, an impedance $z_{OPC}$ per unit area of the lowermost layer at a frequency of $f_{OPC}/10$ (Hz) is $3.0 \times 10^5$ ($\Omega \cdot cm^2$) or more.

7. The process cartridge according to claim 1, wherein, in the electrophotographic photosensitive member, an impedance $z_{OPC}$ per unit area of the lowermost layer at a frequency of $f_{OPC}/10$ (Hz) is $1.0 \times 10^9$ ($\Omega \cdot cm^2$) or less.

8. The process cartridge according to claim 1, wherein, in the charging member, an impedance $z_C$ per unit area of the charging member at a frequency of $f_C/10$ (Hz) is $1.0 \times 10^6$ ($\Omega \cdot cm^2$) (Hz) or more.

9. The process cartridge according to claim 1, wherein, in the charging member, the matrix has a volume resistivity $\rho_M$ of $1.0 \times 10^{12}$ ($\Omega \cdot cm$) or more.

10. An electrophotographic apparatus comprising:

an electrophotographic photosensitive member; and a charging member, wherein the electrophotographic photosensitive member includes a first support having a cylindrical shape, a lowermost layer formed immediately on the first support, and a photosensitive layer formed on the lowermost layer, wherein the charging member is an electrophotographic charging member including a second support having a columnar shape and a second conductive layer formed on the second support, wherein the second conductive layer includes a matrix containing a first rubber and a plurality of domains dispersed in the matrix, wherein the plurality of domains each contain a second rubber and an electron conductive agent, wherein the matrix has a volume resistivity $\rho_M$ that is $1.0 \times 10^5$ times or more as large as a volume resistivity $\rho_D$ of each of the plurality of domains, and wherein, in a case where a maximum frequency at which a phase of an impedance reaches 45°, when the impedance is measured by applying an AC voltage to the lowermost layer while changing the AC voltage at a frequency within a range of from $1.0 \times 10^{-2}$ (Hz) to $1.0 \times 10^6$ (Hz), is represented by $f_{OPC}$ (Hz), and in a case where a maximum frequency at which a phase of an impedance reaches 45°, when the impedance is measured by applying an AC voltage to the charging member while changing the AC voltage at a frequency within a range of from $1.0 \times 10^{-2}$ (Hz) to $1.0 \times 10^6$ (Hz), is represented by $f_C$ (Hz), the $f_{OPC}$ and the $f_C$ satisfy a relationship of one of the following expression (D1) and the following expression (D2):

$$10 \leq f_{OPC}/f_C \leq 10{,}000 \quad \text{Expression (D1)}$$

$$0.0001 \leq f_{OPC}/f_C \leq 0.1 \quad \text{Expression (D2).}$$

* * * * *